US010265592B2

(12) United States Patent
Nakamura

(10) Patent No.: US 10,265,592 B2
(45) Date of Patent: Apr. 23, 2019

(54) GOLF CLUB SHAFT

(71) Applicant: DUNLOP SPORTS CO. LTD., Kobe-shi, Hyogo (JP)

(72) Inventor: Hirotaka Nakamura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/688,160

(22) Filed: Aug. 28, 2017

(65) Prior Publication Data

US 2018/0071598 A1 Mar. 15, 2018

(30) Foreign Application Priority Data

Sep. 9, 2016 (JP) ..... 2016-176358

(51) Int. Cl.
*A63B 53/10* (2015.01)
*A63B 60/00* (2015.01)
*A63B 60/42* (2015.01)

(52) U.S. Cl.
CPC ..... *A63B 53/10* (2013.01); *A63B 60/42* (2015.10); *A63B 2060/002* (2015.10); *A63B 2209/023* (2013.01)

(58) Field of Classification Search
CPC .... A63B 53/10; A63B 2060/002; A63B 60/42
See application file for complete search history.

(56) References Cited

U.S. PATENT DOCUMENTS 6,322,458 B1 * 11/2001 Kusumoto ..... A63B 53/10 473/316
2004/0142760 A1 * 7/2004 Haas ..... A63B 53/10 473/319
2005/0090326 A1 4/2005 Hasegawa
2009/0029792 A1 * 1/2009 Kumamoto ..... A63B 53/10 473/319
2009/0305809 A1 12/2009 Sato
2013/0172097 A1 * 7/2013 Yashiki ..... A63B 53/10 473/316
2013/0324288 A1 * 12/2013 Shiga ..... A63B 60/54 473/319

FOREIGN PATENT DOCUMENTS

JP 2011-92319 A 5/2011

* cited by examiner

*Primary Examiner* — Michael D Dennis
(74) *Attorney, Agent, or Firm* — Birch, Stewart, Kolasch & Birch LLP

(57) ABSTRACT

An EI value at a point P16 separated by 16 inches from a tip end Tp is defined as E16, a shaft wall thickness at the point P16 is defined as T16, an EI value at a point P6 separated by 6 inches from the tip end Tp is defined as E6, and a shaft wall thickness at the point P6 is defined as T6. In a shaft 6, E16 is 2.4 (kgf·m$^2$) or more, E6 is 2.7 (kgf·m$^2$) or less, and E16/E6 is 0.95 or more but 1.50 or less, E6/T6 is 1.9 or less, and E16/T16 is 3.0 or more. A high-elasticity partial reinforcement layer including a fiber having a tensile elastic modulus of 30 (t/mm$^2$) or more but 40 (t/mm$^2$) or less is disposed in at least a part of a region falling within a range of ±4 inches from the point P16.

15 Claims, 9 Drawing Sheets

GOLF CLUB SHAFT

The present application claims priority on Patent Application No. 2016-176358 filed in JAPAN on Sep. 9, 2016, the entire contents of which are hereby incorporated by reference.

BACKGROUND OF THE INVENTION

Field of the Invention

The present invention relates to a golf club Shaft.

Description of the Related Art

In a so-called carbon shaft, lightweight properties and high strength are obtained. In the shaft, the wall thickness of a tip portion is generally increased to secure strength while the total wall thickness of the shaft is decreased to secure lightweight properties. The lightweight shaft provides high-speed swing.

For the purpose of a further added value, a shaft having a devised shaft rigidity distribution has been proposed.

Japanese Unexamined Patent Application Publication No. 2011-92319 discloses a shaft which has a flexural rigidity distribution having a first maximal value and a second maximal value. The first maximal value is located in a range of 250 to 350 mm from a tip end, and the second maximal value is located in a range of 400 to 600 mm from the tip end. Furthermore, a flexural rigidity distribution is defined in Japanese Unexamined Patent Application Publication No. 2009-291405 (US2009/0305809) and Japanese Unexamined Patent Application Publication No. 2005-152613 (US2005/0090326).

SUMMARY OF THE INVENTION

It has been found that a conventional shaft causes difficult capturing although the shaft increases a head speed. As a result of intensive studies for the cause, it has been found that the bending return of the shaft is insufficient at the timing comparatively close to impact during downswing. As a result, it has been found that a swing delay state occurs, which causes difficult capturing to make a hit ball slice. In order to resolve the swing delay, it is considered that a high-elasticity prepreg is disposed over the full length of the shaft, to improve flexural rigidity. However, in that case, the strength of the shaft is apt to be decreased.

The present inventor has made an enthusiastic study, and has found that a novel structure can improve capturing while maintaining high strength.

It is an object of the present invention to provide a golf club shaft which enables weight saving, has high strength, and is easy to capture a ball.

A preferable shaft is formed by a plurality of fiber reinforced layers. The shaft includes a tip end and a butt end. An EI value at a point P16 separated by 16 inches from the tip end is defined as E16 (kgf·m$^2$). A shaft wall thickness at the point P16 is defined as T16 (mm). An EI value at a point P6 separated by 6 inches from the tip end is defined as E6 (kgf·m$^2$). A shaft wall thickness at the point P6 is defined as T6 (mm). E16 is equal to or greater than 2.4 (kgf·m$^2$). E6 is equal to or less than 2.7 (kgf·m$^2$). E16/E6 is 0.95 or greater but 1.50 or less. E6/T6 is equal to or less than 1.9. E16/T16 is equal to or greater than 3.0. A high-elasticity partial reinforcement layer including a fiber having a tensile elastic modulus of 30 (t/mm$^2$) or greater but 40 (t/mm$^2$) or less is disposed in at least a part of a region falling within a range of ±4 inches from the point P16.

Preferably, a glass partial reinforcement layer including a glass fiber is disposed in at least a part of a region falling within a range of ±4 inches from the point P6.

Preferably, the glass partial reinforcement layer is disposed on an inner side with respect to a radial position by which the shaft wall thickness is divided into two equal parts.

Preferably, the glass partial reinforcement layer is an innermost layer.

Preferably, a low-elasticity partial reinforcement layer including a pitch-based carbon fiber having a tensile elastic modulus of equal to or less than 10 (t/mm$^2$) is disposed in at least a part of a region falling within a range of ±4 inches from the point P6.

Preferably, the low-elasticity partial reinforcement layer is disposed on an outer side with respect to a radial position by which the shaft wall thickness is divided into two equal parts.

Preferably, the low-elasticity partial reinforcement layer is disposed at a radial position adjacent to an outermost layer.

DESCRIPTION OF THE PREFERRED EMBODIMENTS

The present invention will be described later in detail based on preferred embodiments with appropriate reference to the drawings.

In the present application, an "axial direction" means an axial direction of a shaft. In the present application, an "region" means a region in the axial direction. In the present application, a "radial direction" means a radial direction of the shaft. In the present application, an "inside" means an inside in the radial direction. In the present application, an "outside" means an outside in the radial direction.

Figure 1:
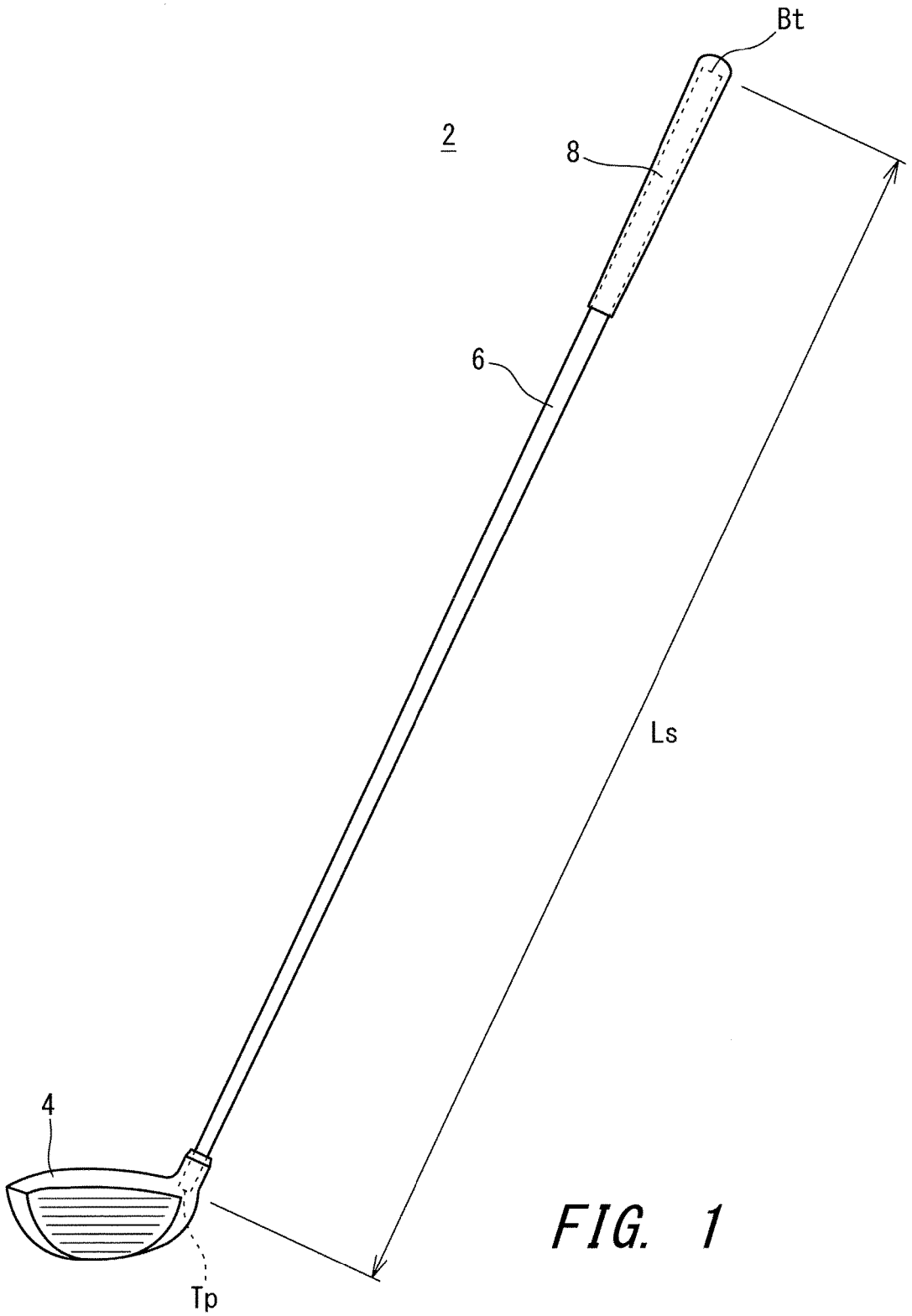
FIG. 1 shows a golf club including a shaft of a first embodiment.

FIG. 1 shows a golf club 2 according to an embodiment of the present invention. The golf club 2 includes a head 4, a shaft 6, and a grip 8. The head 4 is attached to a tip portion of the shaft 6. The grip 8 is attached to a butt portion of the shaft 6. The head 4 has a hollow structure. The head 4 is a wood-type head. The golf club 2 is a driver (a number 1 wood).

As described below, in the present invention, a golf club easy to capture a ball is obtained. As a club length is longer, the head has a tendency to be less likely to turn. Therefore, the longer the club length is, the more conspicuous the effect of the present invention is. In this respect, the golf club 2 has a length of preferably equal to or longer than 43 inches, more preferably equal to or longer than 44 inches, and still more preferably equal to or longer than 45 inches. In light of easiness of swing, the length of the golf club 2 is preferably equal to or shorter than 48 inches, and more preferably equal to or shorter than 47 inches. In light of flight distance, a preferable head 4 is a wood-type golf club head. Preferably, the golf club 2 is a wood-type golf club.

The length of the golf club 2 is measured based on "1c Length" in "1 Clubs" of "Appendix II Design of Clubs" in the Golf Rules defined by R&A (Royal and Ancient Golf Club of Saint Andrews). The length is measured in a state where a club is placed on a horizontal plane and a sole is set against a plane of which an angle with respect to the horizontal plane is 60 degrees. The method for measuring the club length is referred to as a 60-degrees method.

A shaft length is shown by a double-pointed arrow Ls in FIG. 1. The shaft length Ls is a distance between a tip end Tp and a butt end Bt. The distance is measured along the axial direction. As described below, the present invention can control the bending of the shaft during swing. As the club length is longer, the shaft is apt to bend. For this reason, the effect of the present invention is conspicuous as the club length is longer. From this viewpoint, the shaft 6 has a length of preferably equal to or longer than 42 inches, more preferably equal to or longer than 43 inches, and still more preferably equal to or longer than 44 inches. From the viewpoint of easiness of swing, the length of the shaft 6 is preferably equal to or shorter than 47 inches, more preferably equal to or shorter than 46 inches, and still more preferably equal to or shorter than 45 inches. From the viewpoint of a flight distance, a preferable head 4 is a wood-type golf club head. Preferably, the golf club 2 is a wood-type golf club.

As shown in FIG. 1, the shaft 6 includes a tip end Tp and a butt end Bt. In the golf club 2, the tip end Tp is located in the head 4. In the golf club 2, the butt end Bt is located in the grip 8.

A tip part of the shaft 6 is inserted into a hosel hole of the head 4. The axial-direction length of a portion of the shaft 6 inserted into the hosel hole is usually 25 mm or greater but 70 mm or less.

The shaft 6 is a laminate of fiber reinforced resin layers. The shaft 6 is formed by a plurality of fiber reinforced layers. The shaft 6 is a so-called carbon shaft. The shaft 6 is a tubular body.

The shaft 6 is formed by curing a wound prepreg sheet. In a typical prepreg sheet, fibers are oriented substantially in one direction. The prepreg is also referred to as a UD prepreg. The term "UD" stands for uni-direction. Prepregs which are not the UD prepreg may be used. For example, fibers contained in the prepreg sheet may be woven.

The prepreg sheet has a fiber and a resin. The resin is also referred to as a matrix resin. Typically, the fiber is a carbon fiber. Typically, the matrix resin is a thermosetting resin.

The shaft 6 is manufactured by a so-called sheet-winding method. In the prepreg, the matrix resin is in a semi-cured state. The shaft 6 is obtained by winding and curing the prepreg sheet.

The matrix resin may be a thermosetting resin, or may be a thermoplastic resin. Typical examples of the matrix resin include an epoxy resin. In light of shaft strength, the matrix resin is preferably an epoxy resin.

Examples of the fiber include a carbon fiber, a glass fiber, an aramid fiber, a boron fiber, an alumina fiber, and a silicon carbide fiber. Two or more of the fibers may be used in combination. In light of the shaft strength, the fiber is preferably the carbon fiber and the glass fiber.

Figure 2:
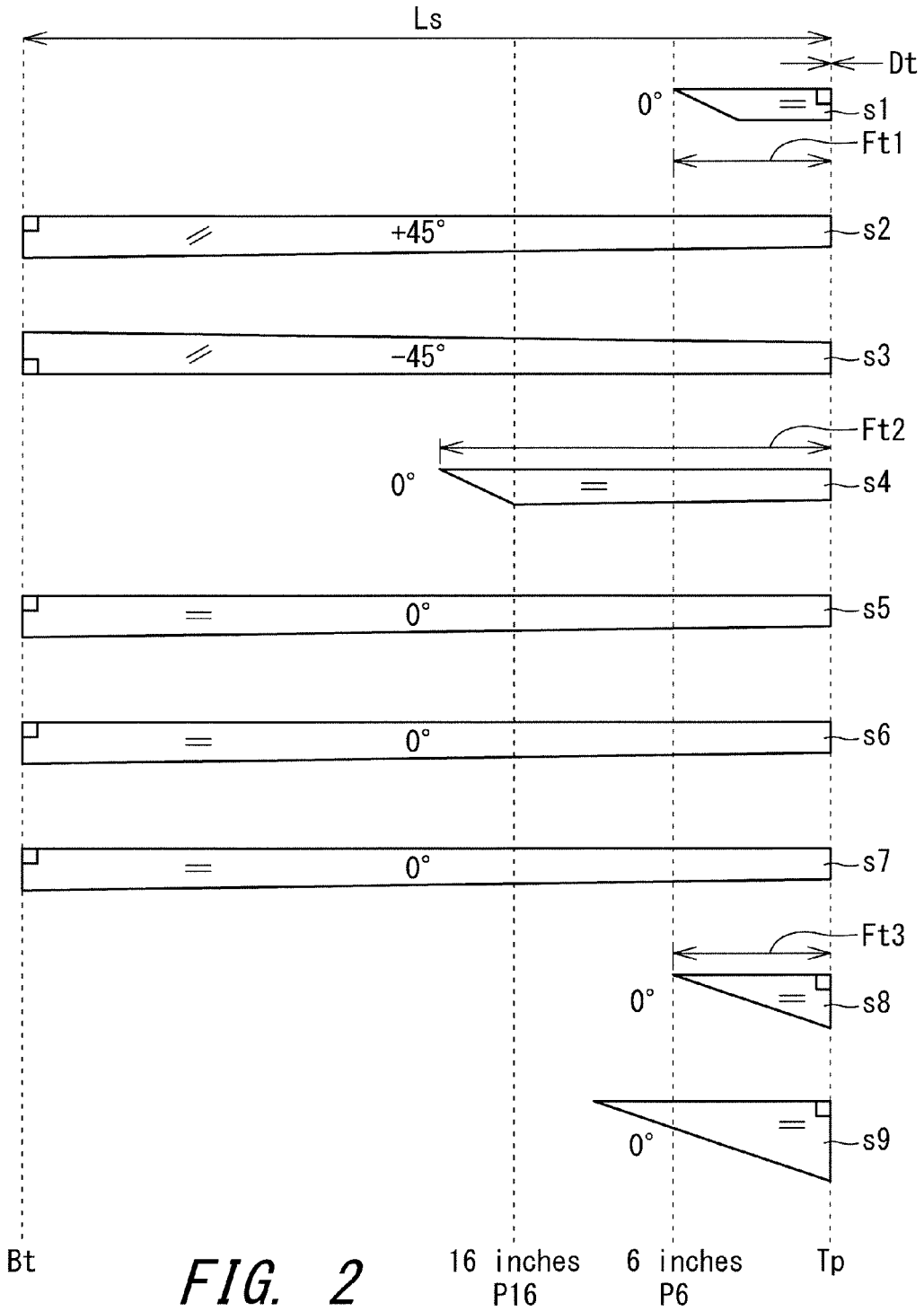
FIG. 2 is a developed view of the shaft of the first embodiment.

FIG. 2 is a developed view (laminated constitution view) of a prepreg sheet constituting the shaft 6.

The shaft 6 is constituted with a plurality of sheets. The shaft 6 is constituted with nine sheets of a first sheet s1 to a ninth sheet s9. The developed view shows the sheets constituting the shaft in order from the radial inside of the shaft. The sheets are wound in order from the sheet located on the uppermost side in the developed view. In the developed view, the horizontal direction of the figure coincides with the axial direction of the shaft. In the developed view, the right side of the figure is the tip end Tp side of the shaft. In the developed view, the left side of the figure is the butt end Bt side of the shaft.

The developed view shows not only the winding order of the sheets but also the disposal of each of the sheets in the axial direction of the shaft. For example, in FIG. 2, an end of the first sheet s1 is located at the tip end Tp.

The term "layer" and the term "sheet" are used in the present application. The "layer" is a term for after being wound. Meanwhile, the "sheet" is a term for before being wound. The "layer" is formed by winding the "sheet". That is, the wound "sheet" forms the "layer". In the present application, the same symbol is used in the layer and the sheet. For example, a layer formed by a sheet s1 is a layer s1.

The shaft 6 includes a straight layer and a bias layer. The shaft 6 does not include a hoop layer. An orientation angle Af of the fiber is described for each of the sheets in the developed view of the present application. The orientation angle Af is an angle with respect to the axial direction of the shaft.

The shaft 6 includes two bias layers. The shaft 6 includes two or more straight layers.

A sheet described as "0°" constitutes the straight layer. The sheet constituting the straight layer is also referred to as a straight sheet.

The straight layer is a layer in which the angle Af is substantially set to 0 degree. Usually, the angle Af is not completely set to 0 degree due to error or the like in winding. Usually, in the straight layer, an absolute angle θa is equal to or less than 10 degrees. The absolute angle θa is an absolute value of the orientation angle Af. For example, "the absolute angle θa is equal to or less than 10 degrees" means that "the angle Af is −10 degrees or greater and +10 degrees or less".

In the embodiment of FIG. 2, the straight sheets are the sheet s1, the sheet s4, the sheet s5, the sheet s6, the sheet s7, the sheet s8, and the sheet s9.

The bias layer is highly correlated with the torsional rigidity and torsional strength of the shaft. Preferably, a bias sheet includes two sheets s2 and s3 in which orientation angles of fibers are inclined in opposite directions to each other. In light of the torsional rigidity, the absolute angle θa of the bias layer is preferably equal to or greater than 15 degrees, more preferably equal to or greater than 25 degrees, and still more preferably equal to or greater than 40 degrees. In light of the torsional rigidity and flexural rigidity, the absolute angle θa of the bias layer is preferably equal to or less than 60 degrees, and more preferably equal to or less than 50 degrees.

In the shaft 6, the sheets constituting the bias layer are the second sheet s2 and the third sheet s3. The sheet s2 is also referred to as a first bias sheet. The sheet s3 is also referred to as a second bias sheet. As described above, in FIG. 2, the angle Af is described in each sheet. The plus (+) and minus (−) in the angle Af show that the fibers of bias sheets are inclined in opposite directions to each other. In the present application, the sheet constituting the bias layer is also merely referred to as a bias sheet. The sheet s2 and the sheet s3 constitute a united sheet to be described later.

In FIG. 2, the inclination direction of the fiber of the sheet s3 is equal to the inclination direction of the fiber of the sheet s2. However, the sheet s3 is reversed, and applied on the sheet s2. As a result, the direction of the angle Af of the sheet s2 and the direction of the angle Af of the sheet s3 are opposite to each other. In light of this point, in the embodiment of FIG. 2, the angle Af of the sheet s2 is described as +45 degrees and the angle Af of the sheet s3 is described as −45 degrees.

The shaft 6 does not include a hoop layer. The shaft 6 may include the hoop layer. Preferably, the absolute angle θa in the hoop layer is substantially 90 degrees to the axis line of the shaft. However, the orientation direction of the fiber to the axial direction of the shaft may not be completely set to 90 degrees due to an error or the like in winding. In the hoop layer, the angle Af is usually −90 degrees or greater and −80 degrees or less, or 80 degrees or greater and 90 degrees or less. In other words, in the hoop layer, the absolute angle θa is usually 80 degrees or greater and 90 degrees or less.

The number of the layers to be formed from one sheet is not limited. For example, if the number of plies of the sheet is 1, the sheet is wound by one round in a circumferential direction. If the number of plies of the sheet is 1, the sheet forms one layer at all positions in the circumferential direction of the shaft.

For example, if the number of plies of the sheet is 2, the sheet is wound by two rounds in the circumferential direction. If the number of plies of the sheet is 2, the sheet forms two layers at the all positions in the circumferential direction of the shaft.

For example, if the number of plies of the sheet is 1.5, the sheet is wound by 1.5 rounds in the circumferential direction. When the number of plies of the sheet is 1.5, the sheet forms one layer at the circumferential position of 0 to 180 degrees, and forms two layers at the circumferential position of 180 degrees to 360 degrees.

In light of suppressing winding fault such as wrinkles, a sheet having a too large width is not preferable. In this respect, the number of plies of one bias sheet is preferably equal to or less than 4, and more preferably equal to or less than 3. In light of the working efficiency of the winding process, the number of plies of the bias sheet is preferably equal to or greater than 1.

In light of suppressing winding fault such as wrinkles, a sheet having a too large width is not preferable. In this respect, the number of plies of one straight sheet is preferably equal to or less than 4, more preferably equal to or less than 3, and still more preferably equal to or less than 2. In light of the working efficiency of the winding process, the number of plies of the straight sheet is preferably equal to or greater than 1. The number of plies may be 1 in all the straight sheets.

In a full length sheet, winding fault is apt to occur. In light of suppressing the winding fault, the number of plies of one sheet in all full length straight sheets is preferably equal to or less than 2. The number of plies may be 1 in all the full length straight sheets.

As described above, in the present application, the sheet and the layer are classified by the orientation angle of the fiber. Furthermore, in the present application, the sheet and the layer are classified by the axial-direction length of the shaft.

In the present application, a layer substantially wholly disposed in the axial direction of the shaft is referred to as a full length layer. In the present application, a sheet substantially wholly disposed in the axial direction of the shaft is referred to as a full length sheet. The wound full length sheet forms the full length layer.

A point of 20 mm distant from the tip end Tp in the axial direction is defined as Tp1, and a region between the tip end Tp and the point Tp1 is defined as a first region. A point of 100 mm distant from the butt end Bt in the axial direction is defined as Bt1, and a region between the butt end Bt and the point Bt1 is defined as a second region. The first region and the second region have a limited influence on the performance of the shaft. In this respect, the full length sheet may not be present in the first region and the second region. Preferably, the full length sheet extends from the tip end Tp to the butt end Bt. In other words, the full length sheet is preferably wholly disposed in the axial direction of the shaft.

In the present application, a layer partially disposed in the axial direction of the shaft is referred to as a partial layer or a partial reinforcement layer. In the present application, the "partial reinforcement layer" is synonymous with a "partial layer". In the present application, a sheet partially disposed in the axial direction of the shaft is referred to as a partial sheet or a partial reinforcement sheet. The wound partial sheet forms the partial layer. The axial-direction length of the partial sheet is shorter than the axial-direction length of the full length sheet. Preferably, the axial-direction length of the partial sheet is equal to or less than half the full length of the shaft.

In the present application, the full length layer that is the straight layer is referred to as a full length straight layer. In the embodiment of FIG. 2, the full length straight layers are a layer s5, a layer s6, and a layer s7. The full length straight sheets are the sheet s5, the sheet s6, and the sheet s7.

In the present application, the partial layer that is the straight layer is referred to as a partial straight layer. In the embodiment of FIG. 2, the partial straight layers are a layer s1, a layer s4, a layer s8, and a layer s9. Partial straight sheets are the sheet s1, the sheet s4, the sheet s8, and the sheet s9.

The term "butt partial layer" is used in the present application. Examples of the butt partial layer include a butt partial straight layer and a butt partial bias layer. In the embodiment of FIG. 2, the butt partial layer is not provided. The butt partial layer may be provided.

The term "tip partial layer" is used in the present application. An axial-direction distance Dt (see FIG. 2) between the tip partial layer (tip partial sheet) and the tip end Tp is preferably equal to or less than 40 mm, more preferably equal to or less than 30 mm, still more preferably equal to or less than 20 mm, and yet still more preferably 0 mm. In the embodiment, the distance Dt is 0 mm.

Examples of the tip partial layer include a tip partial straight layer. In the embodiment of FIG. 2, the tip partial straight layers are the layer s1, the layer s4, the layer s8, and the layer s9. The tip partial straight sheets are the sheet s1, the sheet s4, the sheet s8, and the sheet s9. The tip partial layer increases the strength of the tip portion of the shaft 6.

The shaft 6 is produced by the sheet-winding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine. The cutting may be manually performed. In the manual case, for example, a cutter knife is used.

(2) Stacking Process

In the stacking process, the three united sheets described above are produced.

In the stacking process, heating or a press may be used. More preferably, the heating and the press are used in combination. In a winding process to be described later, the deviation of the sheet may be generated during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets are wound in order described in the developed view. The sheet located on a more upper side in the developed view is earlier wound. The sheets to be stacked are wound in a state of the united sheet.

A winding body is obtained in the winding process. The winding body is obtained by winding the prepreg sheet around the outside of the mandrel. For example, the winding is achieved by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel in light of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, in all the developed views of the present application, the sheets after both the ends are cut are shown. In fact, the cutting of both the ends is considered in the size in cutting. That is, in fact, the cutting is performed in a state where the sizes of both end portions to be cut are added.

(8) Polishing Process

The surface of the cured laminate is polished in the process. Spiral unevenness is present on the surface of the cured laminate. The unevenness is the trace of the wrapping tape. The polishing extinguishes the unevenness to smooth the surface of the cured laminate. Preferably, whole polishing and tip partial polishing are conducted in the polishing process.

(9) Coating Process

The cured laminate after the polishing process is subjected to coating.

The shaft 6 is obtained in the processes. The shaft 6 is lightweight, and has excellent strength.

In light of the strength of the tip portion of the shaft, the axial-direction length of the tip partial layer is preferably equal to or greater than 50 mm, more preferably equal to or greater than 100 mm, and still more preferably equal to or greater than 150 mm. From the viewpoint of the weight saving of the shaft, the axial-direction length of the tip partial layer is preferably equal to or less than 550 mm, more preferably equal to or less than 400 mm, and still more preferably equal to or less than 300 mm.

In the embodiment, a carbon fiber reinforced prepreg and a glass fiber reinforced prepreg are used. Examples of the carbon fiber include a PAN based carbon fiber and a pitch based carbon fiber.

The following terms are used in the present application.

A point separated by 16 inches from the tip end Tp is also referred to as P16.

An EI value at the point P16 is also referred to as E16 ($kgf \cdot m^2$).

A shaft wall thickness at the point P16 is also referred to as T16 (mm). The shaft wall thickness is a radial-direction distance between the inner surface and the outer surface of the shaft. In other words, the shaft wall thickness is [ (shaft outer diameter—shaft inner diameter)/2].

A point separated by 6 inches from the tip end Tp is also referred to as P6.

An EI value at the point P6 is also referred to as E6 ($kgf \cdot m^2$).

A shaft wall thickness at the point P6 is also referred to as T6 (mm).

In the present application, a region falling within a range of ±4 inches from the point P16 is also referred to as RG16. The region falling within the range of ±4 inches from the point P16 is a region between a point separated by 12 inches from the tip end Tp and a point separated by 20 inches from the tip end Tp. Preferably, the region RG16 is a region falling within a range of ±3 inches from the point P16. More preferably, the region RG16 is a region falling within a range of ±2 inches from the point P16. Still more preferably, the region RG16 is a region falling within a range of ±1 inch from the point P16.

In the present application, a region falling within the range of ±4 inches from the point P6 is also referred to as RG6. The region falling within the range of ±4 inches from the point P6 is a region between a point separated by 2 inches from the tip end Tp and a point separated by 10 inches from the tip end Tp. Preferably, the region RG6 is a region falling within the range of ±3 inches from the point P6. More preferably, the region RG6 is a region falling within the range of ±2 inches from the point P6. Still more preferably, the region RG6 is a region falling within the range of ±1 inch from the point P6.

In the present application, a partial layer including a fiber having a tensile elastic modulus of 30 ($t/mm^2$) or greater but 40 ($t/mm^2$) or less is also referred to as a high-elasticity partial reinforcement layer. The fiber is preferably a carbon fiber. Preferably, the high-elasticity partial reinforcement layer is a carbon fiber reinforced layer. Preferably, the carbon fiber is a PAN-based carbon fiber.

In the present application, a partial layer including a glass fiber is also referred to as a glass partial reinforcement layer. The glass partial reinforcement layer is a glass fiber reinforced layer. Preferably, the glass partial reinforcement layer is a straight layer.

In the present application, a partial layer including a pitch-based carbon fiber having a tensile elastic modulus of equal to or less than 10 ($t/mm^2$) is also referred to as a low-elasticity partial reinforcement layer. The low-elasticity partial reinforcement layer is a pitch-based carbon fiber reinforced layer. Preferably, the low-elasticity partial reinforcement layer is a straight layer.

It has been found that a conventional lightweight shaft increases a head speed, but the shaft is apt to make a hit ball slice. It has been assumed that the high head speed shortens time from the start of downswing to impact, as a result of which the face insufficiently turns. In order to solve the problem, the present inventor has made an enthusiastic study. As a result, it has been found that the present invention is effective.

From the viewpoint of easy capturing, it has been found that the flexural rigidity E16 of the point P16 is effectively set to be equal to or greater than 2.4 ($kgf \cdot m^2$). It is presumed that the reason why the effect is provided lies in the behavior of the shaft during downswing.

During downswing, first, a club is swung down in a state where a wrist cock (bending of a wrist) is maintained. Next, the wrist cock is released, and at the same time wrist turn is made. That is, the downswing reaches a cock release phase. In the cock release phase, the face surface turns with the release of the wrist cock, and is bought into impact. If the face is sufficiently turned to provide a square face surface upon impact, side spin such as slice does not occur, and a long flight distance can be obtained. If the face turn is insufficient, the face surface is opened upon impact, which causes slice. The slice decreases the flight distance. When the face turn is excessive, the face surface is closed upon impact, which causes hook. The hook also decreases the flight distance.

In the initial phase of downswing, great bending deformation occurs in the vicinity of the grip in the shaft. A portion in which great bending deformation occurs during downswing is also referred to as a bending point in the present application. Bending return occurs as downswing progresses, so that the bending point is gradually moved to the tip side.

The cock release phase is bought at the timing comparatively close to impact during downswing. It is considered that the cock release phase is bought during the last half of downswing. Therefore, in the cock release phase, it is considered that the bending point is comparatively moved to the tip side.

In the cock release phase, cock release and head turn occur, which cause great acceleration in the head. For this reason, the bending of the shaft toward a head lagging direction is apt to occur, and thus the bending return is delayed. As a result, a swing delay state is caused, so that the face is brought into impact in a state where the face insufficiently turns.

In order to improve the situation, it has been presumed that flexural rigidity is preferably increased in the vicinity of the bending point in the cock release phase. The flexural rigidity E16 has been increased based on the presumption to obtain easy capturing. The effect is also referred to as an E16 effect.

From the viewpoint of improving capturing, E16 is preferably equal to or greater than 2.4 ($kgf \cdot m^2$), more preferably equal to or greater than 2.6 ($kgf \cdot m^2$), and still more preferably equal to or greater than 2.8 ($kgf \cdot m^2$). When E16 is too great, the bending of the shaft becomes insufficient, which may cause a decrease in a head speed. From this viewpoint, E16 is preferably equal to or less than 4.2 ($kgf \cdot m^2$), more preferably equal to or less than 4.0 ($kgf \cdot m^2$), and still more preferably equal to or less than 3.8 ($kgf \cdot m^2$).

The point P6 separated by 6 inches from the tip end Tp is close to the tip end Tp. Rigidity E6 at the point P6 is suppressed, and thereby the tip part of the shaft 6 bends to the direction of movement of swing, and the head is likely to turn. The effect is also referred to as an E6 effect. A synergistic effect is produced by the E6 effect and the above-mentioned E16 effect. By the synergistic effect, easier capturing can be provided.

From the viewpoint of capturing, E6 is preferably equal to or less than 2.7 ($kgf \cdot m^2$), more preferably equal to or less than 2.6 ($kgf \cdot m^2$), and still more preferably equal to or less than 2.5 ($kgf \cdot m^2$). When E6 is too small, the strength of the tip portion of the shaft may become insufficient. From this viewpoint, E6 is preferably equal to or greater than 1.8 ($kgf \cdot m^2$), more preferably equal to or greater than 2.0 ($kgf \cdot m^2$), and still more preferably equal to or greater than 2.2 ($kgf \cdot m^2$).

In order to improve the above-mentioned synergistic effect, it is preferable that E16 is greater and E6 is smaller. That is, E16/E6 is preferably greater. From this viewpoint, E16/E6 is preferably equal to or greater than 0.95, more preferably equal to or greater than 1.05, and still more preferably equal to or greater than 1.15. When E16/E6 is too great, E16 is apt to become too great or E6 is apt to become too small. From this viewpoint, E16/E6 is preferably equal to or less than 1.50, more preferably equal to or less than 1.40, and still more preferably equal to or less than 1.30.

As described above, T6 (mm) is a shaft wall thickness at the point P6. From the viewpoint of strength, T6 is preferably equal to or greater than 1.10 mm, more preferably equal to or greater than 1.20 mm, and still more preferably equal to or greater than 1.30 mm. From the viewpoint of preventing too great E6, T6 is preferably equal to or less than 1.80 mm, more preferably equal to or less than 1.70 mm, and still more preferably equal to or less than 1.60 mm.

In the shaft 6, it is preferable that E6 is suppressed while strength in the region RG6 is secured. From the viewpoint of achieving both capturing and high strength, E6/T6 is preferably equal to or less than 1.9, and more preferably equal to or less than 1.85. When E6/T6 is too small, E6 is apt to become too small or T6 is apt to become too great. From this viewpoint, E6/T6 is preferably equal to or greater than 1.50, more preferably equal to or greater than 1.60, and still more preferably equal to or greater than 1.70.

As described above, T16 (mm) is a shaft wall thickness at the point P16. From the viewpoint of lightweight properties, T16 is preferably equal to or less than 1.40 mm, more preferably equal to or less than 1.30 mm, and still more preferably equal to or less than 1.20 mm. From the viewpoint of strength, T16 is preferably equal to or greater than 0.60 mm, more preferably equal to or greater than 0.70 mm, and still more preferably equal to or greater than 0.80 mm.

In the shaft 6, it is preferable that E16 is increased while lightweight properties are maintained. From the viewpoint of achieving both high E16 and lightweight properties, E16/T16 is preferably equal to or greater than 3.0, more preferably equal to or greater than 3.1, and still more preferably equal to or greater than 3.2. When E16/T16 is too great, E16 is apt to become too great, or T16 is apt to become too small. From this viewpoint, E16/T16 is preferably equal to or less than 4.5, more preferably equal to or less than 4.3, and still more preferably equal to or less than 4.1.

Preferably, a high-elasticity partial reinforcement layer is disposed at least anywhere in the region RG16. A reinforcement fiber of the high-elasticity partial reinforcement layer is a fiber having a tensile elastic modulus of 30 (t/mm$^2$) or greater but 40 (t/mm$^2$) or less.

In the embodiment of FIG. 2, a sheet s4 is the high-elasticity partial reinforcement layer. The high-elasticity partial reinforcement layer s4 is disposed so as to include the tip end Tp, the point P6, and the point P16. The high-elasticity partial reinforcement layer increases the rigidity of the region RG16. The high-elasticity partial reinforcement layer reinforces the region RG16. From this viewpoint, the high-elasticity partial reinforcement layer is also referred to as a 16-inch region reinforcement layer. In the embodiment of FIG. 2, the sheet s4 is the 16-inch region reinforcement layer.

The high-elasticity partial reinforcement layer can increase E16 while maintaining lightweight properties. In order to increase E16, the high-elasticity partial reinforcement layer may be disposed at least anywhere in the region RG16. For example, the high-elasticity partial reinforcement layer maybe disposed in only a part of the region RG16. The region on which the high-elasticity partial reinforcement layer is disposed may not necessarily include P16. If the high-elasticity partial reinforcement layer is disposed in at least a part of the region RG16, an effect of increasing E16 can be provided.

Examples of the disposing form of the high-elasticity partial reinforcement layer (16-inch region reinforcement layer) include the following items (a1) to (a9). A point P12 means a point separated by 12 inches from the tip end Tp, and a point P20 means a point separated by 20 inches from the tip end Tp.

(a1) The tip side end of the high-elasticity partial reinforcement layer is located at the tip end Tp, and the butt side end of the high-elasticity partial reinforcement layer is located on a butt side with respect to the point P16.

(a2) The tip side end of the high-elasticity partial reinforcement layer is located between the tip end Tp and the point P6, and the butt side end of the high-elasticity partial reinforcement layer is located on a butt side with respect to the point P16.

(a3) The tip side end of the high-elasticity partial reinforcement layer is located between the point P6 and the point P16, and the butt side end of the high-elasticity partial reinforcement layer is located on a butt side with respect to the point P16.

(a4) The tip side end of the high-elasticity partial reinforcement layer is located between the point P6 and the point P16, and the butt side end of the high-elasticity partial reinforcement layer is located between the point P16 and the point P20.

(a5) The tip side end of the high-elasticity partial reinforcement layer is located between the point P16 and the point P20, and the butt side end of the high-elasticity partial reinforcement layer is also located between the point P16 and the point P20.

(a6) The tip side end of the high-elasticity partial reinforcement layer is located between the point P12 and the point P16, and the butt side end of the high-elasticity partial reinforcement layer is also located between the point P12 and the point P16.

(a7) The tip side end of the high-elasticity partial reinforcement layer is located between the point P12 and the point P16, and the butt side end of the high-elasticity partial reinforcement layer is located on a butt side with respect to the point P16.

(a8) The tip side end of the high-elasticity partial reinforcement layer is located at the tip end Tp, and the butt side end of the high-elasticity partial reinforcement layer is located between the point P20 and the point P16.

(a9) The tip side end of the high-elasticity partial reinforcement layer is located at the tip end Tp, and the butt side end of the high-elasticity partial reinforcement layer is located between the point P16 and the point P12.

From the viewpoint of increasing E16, the tensile elastic modulus of the fiber in the high-elasticity partial reinforcement layer is preferably equal to or greater than 30 (t/mm$^2$), more preferably equal to or greater than 31 (t/mm$^2$), and still more preferably equal to or greater than 33 (t/mm$^2$). From the viewpoint of strength, the tensile elastic modulus of the fiber in the high-elasticity partial reinforcement layer is preferably equal to or less than 40 (t/mm$^2$), more preferably equal to or less than 38 (t/mm$^2$), and still more preferably equal to or less than 36(t/mm$^2$)

Preferably, a glass partial reinforcement layer is disposed at least anywhere in the region RG6. A reinforcement fiber of the glass partial reinforcement layer is a glass fiber. The tensile elastic modulus of the glass fiber is usually 7 (t/mm$^2$) or greater but 8 (t/mm$^2$) or less.

In the embodiment of FIG. 2, a sheet s1 is the glass partial reinforcement layer. The glass partial reinforcement layer s1 is an innermost layer. The glass partial reinforcement layer s1 is disposed in a range between the tip end Tp and the point P6. The tip side end of the glass partial reinforcement layer s1 is located at the tip end Tp.

The glass partial reinforcement layer can increase strength while suppressing E6 to make a tip part flexible. The glass partial reinforcement layer may be disposed at least anywhere in the region RG6. For example, the glass partial reinforcement layer may be disposed in only a part of the region RG6. The region on which the glass partial reinforcement layer is disposed may not necessarily include P6. If the glass partial reinforcement layer is disposed in at least a part of the region RG6, an effect of increasing strength while suppressing E6 can be provided.

Examples of the disposing form of the glass partial reinforcement layer include the following items (b1) to (b8). A point P2 means a point separated by 2 inches from the tip end Tp, and a point P10 means a point separated by 10 inches from the tip end Tp.

(b1) The tip side end of the glass partial reinforcement layer is located at the tip end Tp, and the butt side end of the glass partial reinforcement layer is located on a butt side with respect to the point P6.

(b2) The tip side end of the glass partial reinforcement layer is located at the tip end Tp, and the butt side end of the glass partial reinforcement layer is located on a butt side with respect to the point P10.

(b3) The tip side end of the glass partial reinforcement layer is located between the point P6 and the point P10, and the butt side end of the glass partial reinforcement layer is also located between the point P6 and the point P10.

(b4) The tip side end of the glass partial reinforcement layer is located between the point P2 and the point P6, and the butt side end of the glass partial reinforcement layer is also located between the point P2 and the point P6.

(b5) The tip side end of the glass partial reinforcement layer is located between the point P2 and the point P6, and the butt side end of the glass partial reinforcement layer is located between the point P6 and the point P10.

(b6) The tip side end of the glass partial reinforcement layer is located between the point P2 and the point P6, and the butt side end of the glass partial reinforcement layer is located on a butt side with respect to the point P6.

(b7) The tip side end of the glass partial reinforcement layer is located at the tip end Tp, and the butt side end of the glass partial reinforcement layer is located between the point P10 and the point P6.

(b8) The tip side end of the glass partial reinforcement layer is located at the tip end Tp, and the butt side end of the glass partial reinforcement layer is located between the point P6 and the point P2.

The tensile elastic modulus of the glass fiber is low. For this reason, the glass partial reinforcement layer contributes to a decrease in E6. The glass fiber does not have a high tensile strength, but it contributes to an improvement in an impact-absorbing energy. By increasing the impact-absorbing energy, an energy before breakage is increased in actual hitting. Asa result, the strength of the shaft in actual use is increased.

From the viewpoint of increasing the impact-absorbing energy while suppressing E6, the glass partial reinforcement layer is preferably disposed inside in a radial direction. From this viewpoint, the glass partial reinforcement layer is preferably disposed on an inner side with respect to a radial position by which the shaft wall thickness is divided into two equal parts. From the same viewpoint, the innermost layer of the shaft 6 is more preferably the glass partial reinforcement layer. In the embodiment of FIG. 2, the innermost layer of the shaft 6 is the glass partial reinforcement layer s1.

Preferably, a low-elasticity partial reinforcement layer including a pitch-based carbon fiber having a tensile elastic modulus of equal to or less than 10 ($t/mm^2$) is disposed at least anywhere in the region RG6. A reinforcement fiber of the low-elasticity partial reinforcement layer is the pitch-based carbon fiber having a tensile elastic modulus of equal to or less than 10 ($t/mm^2$).

In the embodiment of FIG. 2, a sheet s8 is a low-elasticity partial reinforcement layer. The low-elasticity partial reinforcement layer s8 is disposed at a radial position adjacent to a sheet s9 constituting an outermost layer. In other words, the low-elasticity partial reinforcement layer s8 is disposed inside the outermost layer s9 so as to be adjacent to the outermost layer s9. The low-elasticity partial reinforcement layer s8 is covered only with the outermost layer (sheet constituting the outermost layer) s9. The tip side end of the low-elasticity partial reinforcement layer s8 is located at the tip end Tp.

The low-elasticity partial reinforcement layer can increase strength while suppressing E6 to make a tip part flexible. The low-elasticity partial reinforcement layer may be disposed at least anywhere in the region RG6. For example, the low-elasticity partial reinforcement layer may be disposed in only a part of the region RG6. The region on which the low-elasticity partial reinforcement layer is disposed may not necessarily include P6. If the low-elasticity partial reinforcement layer is disposed in at least apart of the region RG6, an effect of increasing strength while suppressing E6 can be provided.

The synergistic effect of the low-elasticity partial reinforcement layer and the glass partial reinforcement layer further improves the effect of increasing strength while suppressing E6.

Examples of the disposing form of the low-elasticity partial reinforcement layer include the following items (c1) to (c8).

(c1) The tip side end of the low-elasticity partial reinforcement layer is located at the tip end Tp, and the butt side end of the low-elasticity partial reinforcement layer is located on a butt side with respect to the point P6.

(c2) The tip side end of the low-elasticity partial reinforcement layer is located at the tip end Tp, and the butt side end of the low-elasticity partial reinforcement layer is located on a butt side with respect to the point P10.

(c3) The tip side end of the low-elasticity partial reinforcement layer is located between the point P6 and the point P10, and the butt side end of the low-elasticity partial reinforcement layer is also located between the point P6 and the point P10.

(c4) The tip side end of the low-elasticity partial reinforcement layer is located between the point P2 and the point P6, and the butt side end of the low-elasticity partial reinforcement layer is also located between the point P2 and the point P6.

(c5) The tip side end of the low-elasticity partial reinforcement layer is located between the point P2 and the point P6, and the butt side end of the low-elasticity partial reinforcement layer is located between the point P6 and the point P10.

(c6) The tip side end of the low-elasticity partial reinforcement layer is located between the point P2 and the point P6, and the butt side end of the low-elasticity partial reinforcement layer is located on a butt side with respect to the point P6.

(c7) The tip side end of the low-elasticity partial reinforcement layer is located at the tip end Tp, and the butt side end of the low-elasticity partial reinforcement layer is located between the point P10 and the point P6.

(c8) The tip side end of the low-elasticity partial reinforcement layer is located at the tip end Tp, and the butt side end of the low-elasticity partial reinforcement layer is located between the point P6 and the point P2.

The lower limit of the tensile elastic modulus of the fiber in the low-elasticity partial reinforcement layer is not particularly limited. From the viewpoint of easy availability, the tensile elastic modulus of the fiber in the low-elasticity partial reinforcement layer is preferably equal to or greater than 5 ($t/mm^2$), more preferably equal to or greater than 8 ($t/mm^2$), and still more preferably equal to or greater than 9 ($t/mm^2$).

From the viewpoint of increasing the impact-absorbing energy while suppressing E6, the low-elasticity partial reinforcement layer is preferably disposed outside in a radial direction. From this viewpoint, the low-elasticity partial reinforcement layer is preferably disposed on an outer side with respect to a radial position by which the shaft wall thickness is divided into two equal parts. From the same viewpoint, the low-elasticity partial reinforcement layer is more preferably disposed inside the outermost layer of the shaft 6 so as to be adjacent to the outermost layer. In other words, the low-elasticity partial reinforcement layer is preferably disposed at a radial position adjacent to the outermost layer. That is, the low-elasticity partial reinforcement layer is preferably located on an outermost side in a radial direction except for the outermost layer (sheet constituting the outermost layer). The constitution is adopted also for the embodiment of FIG. 2.

The axial-direction length of the glass partial reinforcement layer is shown by a double-pointed arrow Ft1 in FIG. 2. From the viewpoint of increasing the impact-absorbing energy, the length Ft1 is preferably equal to or greater than 50 mm, more preferably equal to or greater than 100 mm, and still more preferably equal to or greater than 150 mm. From the viewpoint of the weight saving of the shaft, the length Ft1 is preferably equal to or less than 300 mm, preferably equal to or less than 250 mm, and still more preferably equal to or less than 200 mm.

The axial-direction length of the high-elasticity partial reinforcement layer (16-inch region reinforcement layer) is shown by a double-pointed arrow Ft2 in FIG. 2. From the viewpoint of promoting bending return to provide easy capturing, the length Ft2 is preferably equal to or greater than 300 mm, more preferably equal to or greater than 350 mm, and still more preferably equal to or greater than 400 mm. When the length Ft2 is too great, a region having a high rigidity is excessively enlarged, and thus the above-mentioned E16 effect is less likely to be obtained. From this viewpoint, and the viewpoint of the weight saving of the shaft, the length Ft2 is preferably equal to or less than 550 mm, more preferably equal to or less than 500 mm, and still more preferably equal to or less than 450 mm.

In order to improve the above-mentioned E16 effect, it is preferable that the high-elasticity partial reinforcement layer is not disposed in a portion on a butt side with respect to the region RG16. From this viewpoint, it is preferable that the high-elasticity partial reinforcement layer is not present.: in a region on a butt side with respect to a point P22. It is more preferable that the high-elasticity partial reinforcement layer is not present in a region on a butt side with respect to a point P21. It is still more preferable that the high-elasticity partial reinforcement layer is not present in a region on a butt side with respect to the point P20. The point P22 means a point separated by 22 inches from the tip end Tp, and the point P21 means a point separated by 21 inches from the tip end Tp.

The axial-direction length of the low-elasticity partial reinforcement layer is shown by a double-pointed arrow Ft3 in FIG. 2. From the viewpoint of increasing the impact-absorbing energy, the length Ft3 is preferably equal to or greater than 50 mm, more preferably equal to or greater than 100 mm, and still more preferably equal to or greater than 150 mm. From the viewpoint of the weight saving of the shaft, the length Ft3 is preferably equal to or less than 300 mm, more preferably equal to or less than 250 mm, and still more preferably equal to or less than 200 mm.

Even if the shaft of the present invention is lightweight, the shaft is easy to capture a ball, and has high strength. Therefore, in the lightweight shaft, the effect of the present invention is conspicuous. From this viewpoint, a shaft weight is preferably equal to or less than 68 g, more preferably equal to or less than 67 g, still more preferably equal to or less than 66 g, yet still more preferably equal to or less than 65 g, further preferably equal to or less than 64 g, still further preferably equal to or less than 63 g, and yet further preferably equal to or less than 62 g. From the viewpoint of the degree of freedom of design, the shaft weight is preferably equal to or greater than 40 g, more preferably equal to or greater than 50 g, and still more preferably equal to or greater than 55 g.

The following tables 1 and 2 show examples of utilizable prepregs. These prepregs are commercially available.

TABLE 1

Examples of usable prepregs

| Manufacturer | Trade name | Thickness of shee t(mm) | Fiber content (% by mass) | Resin content (% by mass) | Physical property value of reinforcement fiber: Part number of fiber | Tensile elastic modulus (t/mm$^2$) | Tensile strength (kgf/mm$^2$) |
|---|---|---|---|---|---|---|---|
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |
| Toray Industries, Inc. | 805S-3 | 0.034 | 60 | 40 | M30S | 30 | 560 |
| Toray Industries, Inc. | 8053S-3 | 0.028 | 70 | 30 | M30S | 30 | 560 |
| Toray Industries, Inc. | 9255S-7A | 0.056 | 78 | 22 | M40S | 40 | 470 |
| Toray Industries, Inc. | 9255S-6A | 0.047 | 76 | 24 | M40S | 40 | 470 |

TABLE 1-continued

| Examples of usable prepregs | | | | | | | |
|---|---|---|---|---|---|---|---|
| | | | | | Physical property value of reinforcement fiber | | |
| Manufacturer | Trade name | Thickness of shee t(mm) | Fiber content (% by mass) | Resin content (% by mass) | Part number of fiber | Tensile elastic modulus ($t/mm^2$) | Tensile strength ($kgf/mm^2$) |
| Toray Industries, Inc. | 925AS-4C | 0.038 | 65 | 35 | M40S | 40 | 470 |
| Toray Industries, Inc. | 9053S-4 | 0.027 | 70 | 30 | M40S | 40 | 470 |
| Toray Industries, Inc. | 17045G-10 | 0.082 | 76 | 24 | T1100G | 33 | 675 |
| Toray Industries, Inc. | 17045G-12 | 0.103 | 76 | 24 | T1100G | 33 | 675 |
| Nippon Graphite Fiber Corporation | E052AA-10N | 0.110 | 63 | 37 | XN-05 | 5 | 120 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |

Tensile strength and tensile elastic modulus are values measured based on JIS R7601: 1986 "Testing methods for carbon fibers".

TABLE 2

| Examples of usable prepregs | | | | | | | |
|---|---|---|---|---|---|---|---|
| | | | | | Physical property value of reinforcement fiber | | |
| Manufacturer | Trade name | Thickness of sheet(mm) | Fiber content (% by mass) | Resin content (% by mass) | Part number of fiber | Tensile elastic modulus ($t/mm^2$) | Tensile strength ($kgf/mm^2$) |
| Mitsubishi Rayon Co., Ltd. | GE352H-160S | 0.150 | 65 | 35 | E glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | TR350C-175S | 0.147 | 75 | 25 | TR50S | 24 | 500 |
| Mitsubishi Rayon Co., Ltd. | MR350J-025S | 0.034 | 63 | 37 | MR40 | 30 | 450 |
| Mitsubishi Rayon Co., Ltd. | MR350J-050S | 0.058 | 63 | 37 | MR40 | 30 | 450 |
| Mitsubishi Rayon Co., Ltd. | MR350C-050S | 0.05 | 75 | 25 | MR40 | 30 | 450 |
| Mitsubishi Rayon Co., Ltd. | MR350C-075S | 0.063 | 75 | 25 | MR40 | 30 | 450 |
| Mitsubishi Rayon Co., Ltd. | MRX350C-075R | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |

TABLE 2-continued

| Examples of usable prepregs | | | | | | | |
|---|---|---|---|---|---|---|---|
| | | | | | Physical property value of reinforcement fiber | | |
| Manufacturer | Trade name | Thickness of sheet(mm) | Fiber content (% by mass) | Resin content (% by mass) | Part number of fiber | Tensile elastic modulus ($t/mm^2$) | Tensile strength ($kgf/mm^2$) |
| Mitsubishi Rayon Co., Ltd. | HRX350C-110S | 0.082 | 75 | 25 | HR40 | 40 | 450 |

Tensile strength and tensile elastic modulus are values measured based on JIS R7601: 1986 "Testing methods for carbon fibers".

EXAMPLES

Hereinafter, the effects of the present invention will be clarified by examples. However, the present invention should not be interpreted in a limited way based on the description of examples.

Example 1

A shaft of Example 1 was obtained in the same manner as in the manufacturing process of the above-mentioned shaft 6. A laminated constitution of Example 1 was as shown in FIG. 2. In Example 1, the following materials were used for sheets.

First sheet sl: "GE352H-160S" manufactured by Mitsubishi Rayon Co., Ltd.

Second sheet s2: "HRX350C-110S" manufactured by Mitsubishi Rayon Co., Ltd.

Third sheet s3: "HRX350C-110S" manufactured by Mitsubishi Rayon Co., Ltd.

Fourth sheet s4: "17045G-10" manufactured by Toray Industries, Inc.

Fifth sheet s5: "MRX350C-100S" manufactured by Mitsubishi Rayon Co., Ltd.

Sixth sheet s6: "MRX350C-100S" manufactured by Mitsubishi Rayon Co., Ltd.

Seventh sheet s7: "3225S-15" manufactured by Toray Industries, Inc.

Eighth sheet s8: "E1026A-09N" manufactured by Nippon Graphite Fiber Corporation Ninth sheet s9: "3225S-10" manufactured by Toray Industries, Inc.

A head for a driver and a grip were attached to the obtained shaft to obtain a golf club according to Example 1. A head "SRIXON 2545 driver" (loft 10.5 degrees) manufactured by Dunlop Sports Co., Ltd. was used as the head.

Specifications and results of evaluations for Example 1 are shown in Tables 3 to 8 below. From the viewpoint of easiness of comparison, the specifications and the results of evaluations for Example 1 are described in all of Tables 3 to 8 below.

In Tables 3 to 8 below, the presence or absence of use of a glass partial reinforcement layer in a region RG6 is shown by "o" or "x". "o " means the use of the glass partial reinforcement layer, and "x" means the non-use of the glass partial reinforcement layer. In Tables 3 to 8 below, the presence or absence of use of a low-elasticity partial reinforcement layer in the region RG6 is shown by "o" or "x". "o " means the use of the low-elasticity partial reinforcement layer, and "x" means the non-use of the low-elasticity partial reinforcement layer.

Examples 2, 3 and Comparative Examples 1, 2

Examples 2, 3 and Comparative Examples 1, 2 were obtained in the same manner as in Example 1 except that prepregs used in a laminated constitution of FIG. 2, and the sizes of the prepregs were appropriately selected to provide specifications shown in Table 3. Results of evaluations for Examples 2, 3 and Comparative Examples 1, 2 are shown in Table 3 below.

In Example 1, a prepreg having a fiber elastic modulus of 33 ($t/mm^2$) was used as a sheet s4 of FIG. 2. Meanwhile, in Comparative Example 1, a prepreg having a fiber elastic modulus of 24 ($t/mm^2$) was used as the sheet s4 of FIG. 2. In Example 2, a prepreg having a fiber elastic modulus of 30 ($t/mm^2$) was used as the sheet s4 of FIG. 2. In Example 3, a prepreg having a fiber elastic modulus of 40 ($t/mm^2$) was used as the sheet s4 of FIG. 2. In Comparative Example 2, a prepreg having a fiber elastic modulus of 46 ($t/mm^2$) was used as the sheet s4 of FIG. 2.

Examples 4, 5 and Comparative Examples 3, 4

Examples 4, 5 and Comparative Examples 3, 4 were obtained in the same manner as in Example 1 except that prepregs used in a laminated constitution of FIG. 2, and the sizes of the prepregs were appropriately selected to provide specifications shown in Table 4. Results of evaluations for Examples 4, 5 and Comparative Examples 3, 4 are shown in Table 4 below. In Table 4, a thickness T6 is changed.

Examples 6 to 8 and Comparative Example 5

Examples 6 to 8 and Comparative Example 5 were obtained in the same manner as in Example 1 except that prepregs used in a laminated constitution of FIG. 2, and the sizes of the prepregs were appropriately selected to provide specifications shown in Table 5. Results of evaluations for Examples 6 to 8 and Comparative Example 5 are shown in Table 5 below. In Table 5, a thickness T16 is changed.

Examples 9, 10 and Comparative Examples 6, 7

Examples 9, 10 and Comparative Examples 6, 7 were obtained in the same manner as in Example 1 except that prepregs used in a laminated constitution of FIG. 2, and the sizes of the prepregs were appropriately selected to provide specifications shown in Table 6. Results of evaluations for Examples 9, 10 and Comparative Examples 6, 7 are shown in Table 6 below. In Table 6, a thickness T6 and a thickness T16 are changed.

Comparative Examples 8 to 10

Comparative Examples 8 to 10 were obtained in the same manner as in Example 1 except that prepregs used in a laminated constitution of FIG. 2, and the sizes of the prepregs were appropriately selected to provide specifications shown in Table 7. Results of evaluations for Comparative Examples 8 to 10 are shown in Table 7 below.

In Comparative Example 8, a glass partial reinforcement layer used as a sheet s1 of FIG. 2 was replaced by a partial layer reinforced with a carbon fiber. The tensile elastic modulus of the carbon fiber was 24 (t/mm$^2$).

In Comparative Example 9, a glass partial reinforcement layer used as a sheet s1 of FIG. 2 was replaced by a partial layer reinforced with a carbon fiber. The tensile elastic modulus of the carbon fiber was 24 (t/mm$^2$). In addition, in Comparative Example 9, a low-elasticity partial reinforcement layer used as a sheet s8 of FIG. 2 was replaced by a partial layer reinforced with a PAN-based carbon fiber having a tensile elastic modulus of 24 (t/mm$^2$). The tensile elastic modulus of the PAN-based carbon fiber was 24 (t/mm$^2$).

In Comparative Example 10, a prepreg having a fiber elastic modulus of 24 (t/mm$^2$) was used as a sheet s4 of FIG. 2, and a thickness T16 was increased.

Example 11

Figure 3:
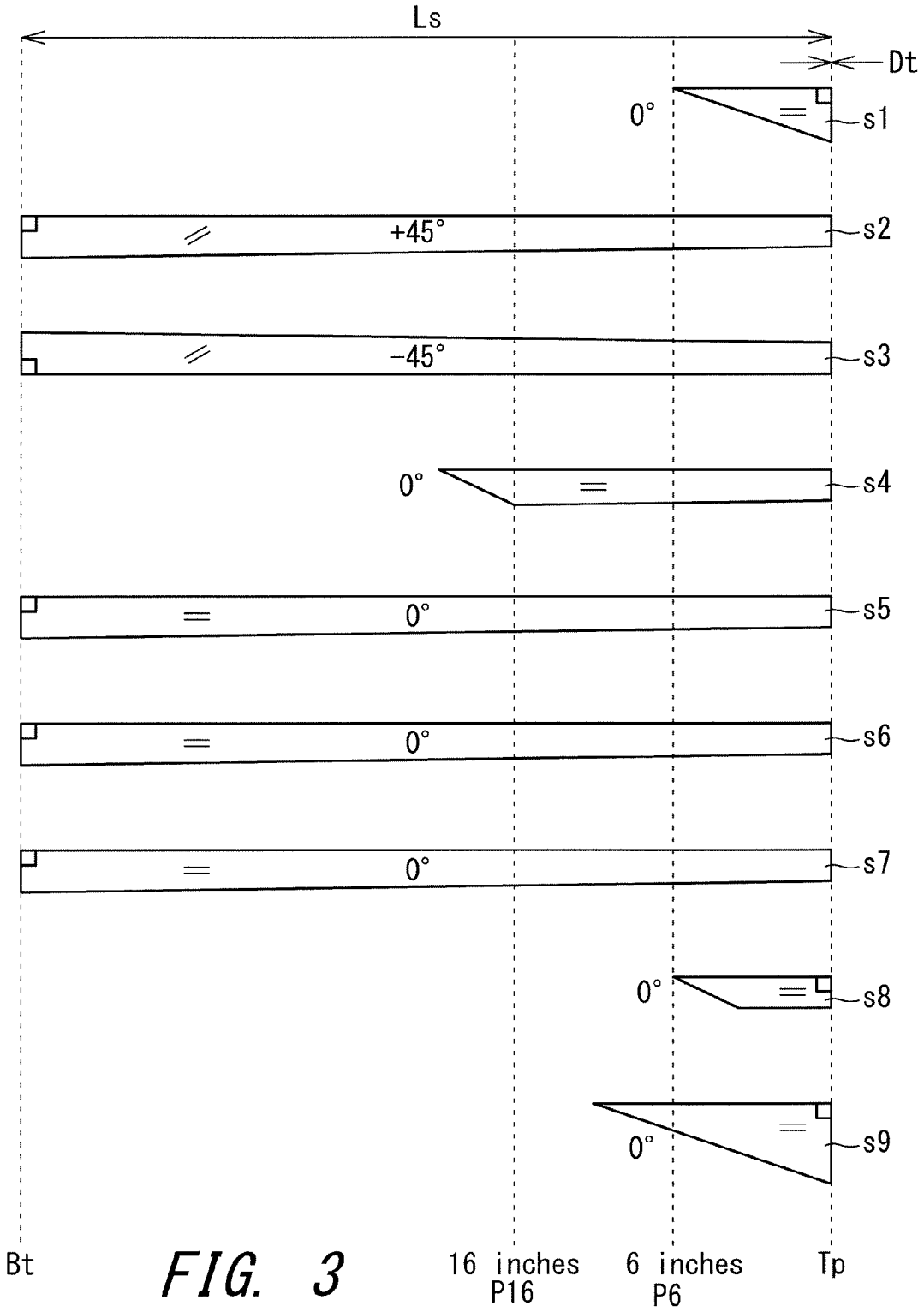
FIG. 3 is a developed view of a shaft of a second embodiment (Example 11)

A laminated constitution of Example 11 is shown in FIG. 3. Example 11 was obtained in the same manner as in Example 1 except that a lamination order between a sheet s1 and a sheet s8 was reversed. As a result, in Example 11, a glass partial reinforcement layer was set on an outer side (a position adjacent to an outermost layer s9), and a low-elasticity partial reinforcement layer was set on an inner side (innermost layer). Specifications and results of evaluations for Example 11 are shown in Table 8 below.

Example 12

Figure 4:
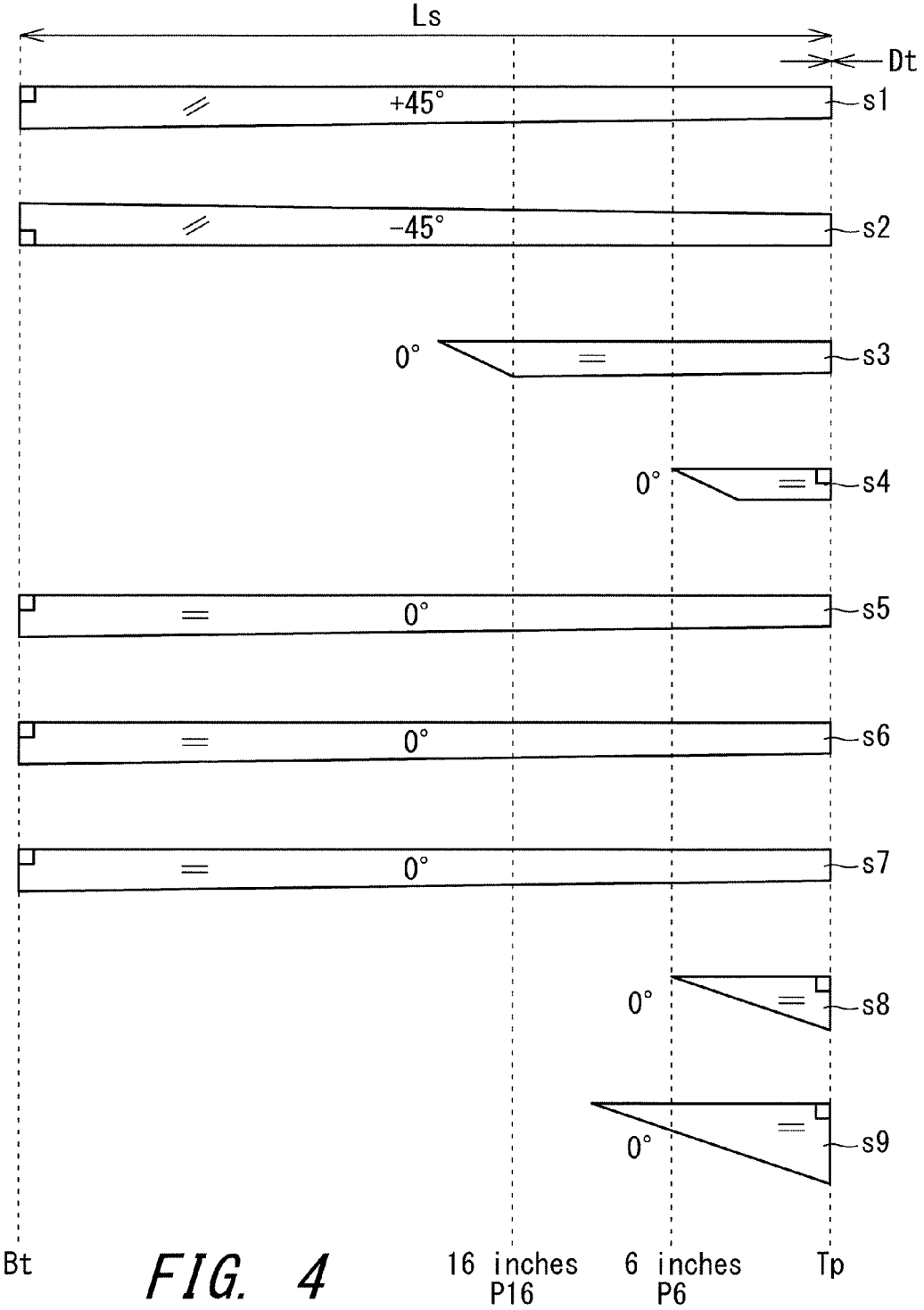
FIG. 4 is a developed view of a shaft of a third embodiment (Example 12)

A laminated constitution of Example 12 is shown in FIG. 4. Example 12 was obtained in the same manner as in Example 1 except that a lamination order was changed so that a glass partial reinforcement layer used as a first sheet s1 was used as a fourth sheet s4. As a result, in Example 12, the glass partial reinforcement layer was located between a sheet s3 (high-elasticity partial reinforcement layer) and a sheet s5 (innermost full length straight layer). Specifications and results of evaluations for Example 12 are shown in Table 8 below.

Example 13

Figure 5:
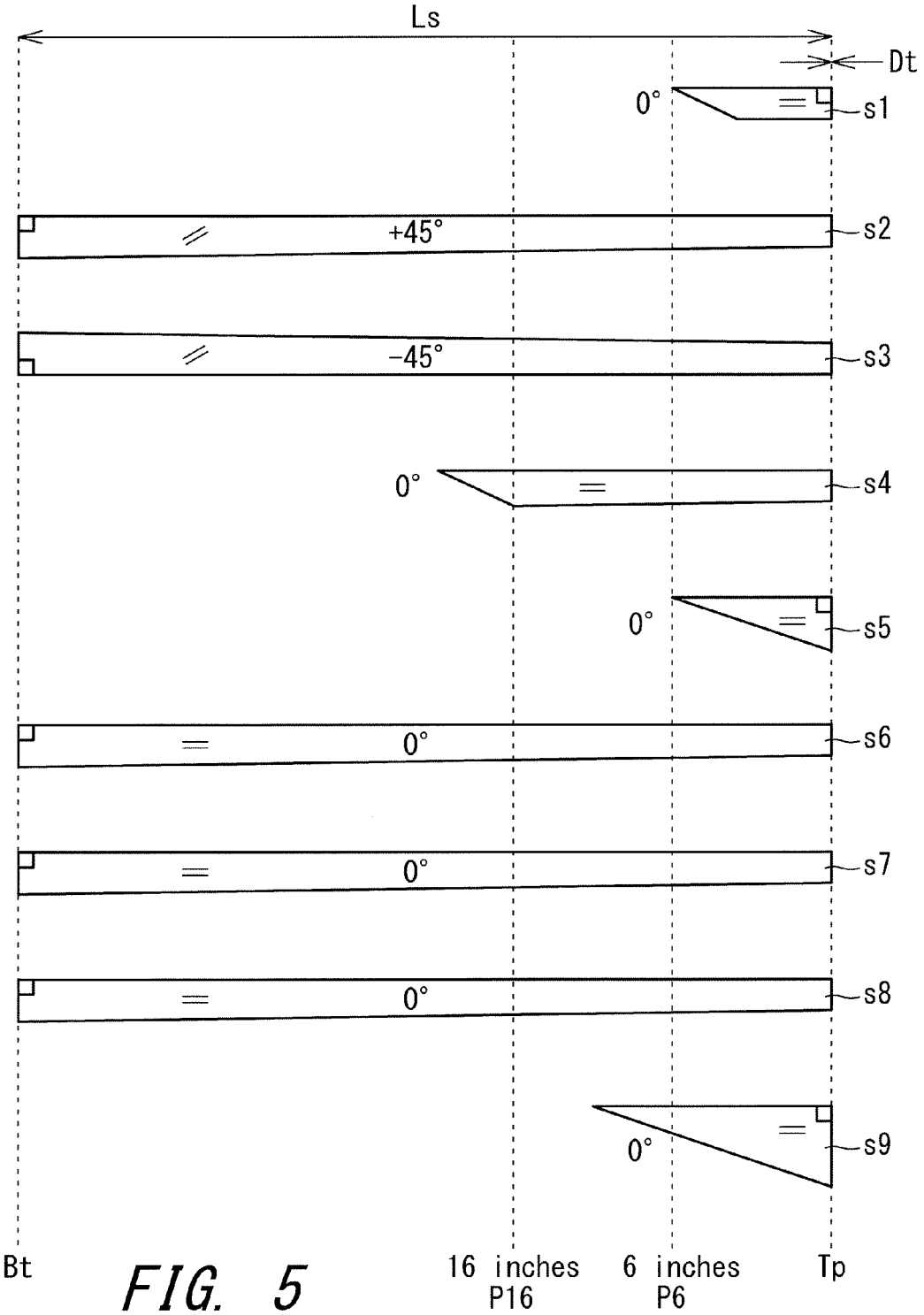
FIG. 5 is a developed view of a shaft of a fourth embodiment (Example 13)

A laminated constitution of Example 13 is shown in FIG. 5. Example 13 was obtained in the same manner as in Example 1 except that a lamination order was changed so that a low-elasticity partial reinforcement layer used as an eighth sheet s8 was used as a fifth sheet s5. As a result, in Example 13, the low-elasticity partial reinforcement layer was located between a sheet s4 (high-elasticity partial reinforcement layer) and a sheet s6 (innermost full length straight layer). Specifications and results of evaluations for Example 13 are shown in Table 8 below.

TABLE 3

Specifications and results of evaluations for Examples and Comparative Examples

| Item | Unit | Ex. 1 | Comp. Ex. 1 | Ex. 2 | Ex. 3 | Comp. Ex. 2 |
|---|---|---|---|---|---|---|
| Shaft weight | g | 63.0 | 63.0 | 63.0 | 63.0 | 63.0 |
| Shaft length | mm | 1168 | 1168 | 1168 | 1168 | 1168 |
| T6 | mm | 1.40 | 1.40 | 1.40 | 1.40 | 1.40 |
| T16 | mm | 0.92 | 0.92 | 0.92 | 0.92 | 0.92 |
| E6 | kgf · m$^2$ | 2.53 | 2.53 | 2.53 | 2.53 | 2.53 |
| E16 | kgf · m$^2$ | 3.13 | 2.40 | 2.92 | 3.60 | 4.00 |
| E16/E6 | — | 1.24 | 0.95 | 1.15 | 1.42 | 1.58 |
| E6/T6 | — | 1.81 | 1.81 | 1.81 | 1.81 | 1.81 |
| E16/T16 | — | 3.40 | 2.61 | 3.17 | 3.91 | 4.35 |
| Fiber elastic modulus of high-elasticity partial reinforcement layer used in region RG16 | — | 33t | 24t | 30t | 40t | 46t |
| Use of glass partial reinforcement layer in region RG6 | — | ○ | ○ | ○ | ○ | ○ |
| Use of low-elasticity partial reinforcement layer in region RG6 | — | ○ | ○ | ○ | ○ | ○ |
| Head speed | m/s | 42 | 42 | 42 | 42 | 42 |
| Flight distance carry | yds | 200 | 196 | 199 | 197 | 195 |
| Position of point where ball falls in right or left direction | yds | 0 | 12 | 3 | −8 | −14 |
| Impact-absorbing energy | J | 3.7 | 3.7 | 3.7 | 3.7 | 3.7 |
| Three-point flexural strength (A point) | — | 100% | 100% | 100% | 100% | 100% |
| Three-point flexural strength (AB middle point) | — | 100% | 113% | 105% | 90% | 80% |

TABLE 4

Specifications and results of evaluations for Examples and Comparative Examples

| Item | Unit | Ex. 1 | Comp. Ex. 3 | Ex. 4 | Ex. 5 | Comp. Ex. 4 |
|---|---|---|---|---|---|---|
| Shaft weight | g | 63.0 | 61.0 | 61.5 | 64.0 | 64.5 |
| Shaft length | mm | 1168 | 1168 | 1168 | 1168 | 1168 |
| T6 | mm | 1.40 | 1.27 | 1.32 | 1.45 | 1.49 |
| T16 | mm | 0.92 | 0.92 | 0.92 | 0.92 | 0.92 |
| E6 | $kgf \cdot m^2$ | 2.53 | 2.06 | 2.22 | 2.67 | 2.79 |
| E16 | $kgf \cdot m^2$ | 3.13 | 3.13 | 3.13 | 3.13 | 3.13 |
| E16/E6 | — | 1.24 | 1.52 | 1.41 | 1.17 | 1.12 |
| E6/T6 | — | 1.81 | 1.62 | 1.68 | 1.84 | 1.87 |
| E16/T16 | — | 3.40 | 3.40 | 3.40 | 3.40 | 3.40 |
| Fiber elastic modulus of high-elasticity partial reinforcement layer used in region RG16 | — | 33t | 33t | 33t | 33t | 33t |
| Use of glass partial reinforcement layer in region RG6 | — | ○ | ○ | ○ | ○ | ○ |
| Use of low-elasticity partial reinforcement layer in region RG6 | — | ○ | ○ | ○ | ○ | ○ |
| Head speed | m/s | 42 | 42.4 | 42.3 | 41.8 | 41.7 |
| Flight distance carry | yds | 200 | 200 | 201 | 197 | 195 |
| Position of point where ball falls in right or left direction | yds | 0 | −12 | −7 | 3 | 5 |
| Impact-absorbing energy | J | 3.7 | 3.5 | 3.6 | 3.8 | 3.9 |
| Three-point flexural strength (A point) | — | 100% | 80% | 87% | 112% | 120% |
| Three-point flexural strength (AB middle point) | — | 100% | 100% | 100% | 100% | 100% |

TABLE 5

Specifications and results of evaluations for Examples and Comparative Examples

| Item | Unit | Ex. 1 | Comp. Ex. 5 | Ex. 6 | Ex. 7 | Ex. 8 |
|---|---|---|---|---|---|---|
| Shaft weight | g | 63.0 | 61.0 | 61.5 | 64.0 | 65.0 |
| Shaft length | mm | 1168 | 1168 | 1168 | 1168 | 1168 |
| T6 | mm | 1.40 | 1.40 | 1.40 | 1.40 | 1.40 |
| T16 | mm | 0.92 | 0.75 | 0.80 | 1.00 | 1.10 |
| E6 | $kgf \cdot m^2$ | 2.53 | 2.53 | 2.53 | 2.53 | 2.53 |
| E16 | $kgf \cdot m^2$ | 3.13 | 2.24 | 2.45 | 3.40 | 3.74 |
| E16/E6 | — | 1.24 | 0.89 | 0.97 | 1.34 | 1.48 |
| E6/T6 | — | 1.81 | 1.81 | 1.81 | 1.81 | 1.81 |
| E16/T16 | — | 3.40 | 2.99 | 3.06 | 3.40 | 3.40 |
| Fiber elastic modulus of high-elasticity partial reinforcement layer used in region RG16 | — | 33t | 33t | 33t | 33t | 33t |
| Use of glass partial reinforcement layer in region RG6 | — | ○ | ○ | ○ | ○ | ○ |
| Use of low-elasticity partial reinforcement layer in region RG6 | — | ○ | ○ | ○ | ○ | ○ |

TABLE 5-continued

Specifications and results of evaluations for Examples and Comparative Examples

| Item | Unit | Ex. 1 | Comp. Ex. 5 | Ex. 6 | Ex. 7 | Ex. 8 |
|---|---|---|---|---|---|---|
| Head speed | m/s | 42 | 42.4 | 42.3 | 41.8 | 41.6 |
| Flight distance carry | yds | 200 | 199 | 199 | 197 | 193 |
| Position of point where ball falls in right or left direction | yds | 0 | 15 | 11 | −4 | −10 |
| Impact-absorbing energy | J | 3.7 | 3.7 | 3.7 | 3.7 | 3.7 |
| Three-point flexural strength (A point) | — | 100% | 100% | 100% | 100% | 100% |
| Three-point flexural strength (AB middle point) | — | 100% | 80% | 86% | 112% | 123% |

TABLE 6

Specifications and results of evaluations for Examples and Comparative Examples

| Item | Unit | Ex. 1 | Comp. Ex. 6 | Ex. 9 | Ex. 10 | Comp. Ex. 7 |
|---|---|---|---|---|---|---|
| Shaft weight | g | 63.0 | 63.0 | 60.5 | 64.5 | 62.0 |
| Shaft length | mm | 1168 | 1168 | 1168 | 1168 | 1168 |
| T6 | mm | 1.40 | 1.32 | 1.32 | 1.45 | 1.45 |
| T16 | mm | 0.92 | 1.00 | 0.80 | 1.00 | 0.80 |
| E6 | kgf · $m^2$ | 2.53 | 2.22 | 2.22 | 2.67 | 2.67 |
| E16 | kgf · $m^2$ | 3.13 | 3.40 | 2.45 | 3.40 | 2.45 |
| E16/E6 | — | 1.24 | 1.53 | 1.10 | 1.27 | 0.92 |
| E6/T6 | — | 1.81 | 1.68 | 1.68 | 1.84 | 1.84 |
| E16/T16 | — | 3.40 | 3.40 | 3.06 | 3.40 | 3.06 |
| Fiber elastic modulus of high-elasticity partial reinforcement layer used in region RG16 | — | 33t | 33t | 33t | 33t | 33t |
| Use of glass partial reinforcement layer in region RG6 | — | ○ | ○ | ○ | ○ | ○ |
| Use of low-elasticity partial reinforcement layer in region RG6 | — | ○ | ○ | ○ | ○ | ○ |
| Head speed | m/s | 42 | 42 | 42.5 | 41.7 | 42.2 |
| Flight distance carry | yds | 200 | 196 | 203 | 197 | 198 |
| Position of point where ball falls in right or left direction | yds | 0 | −12 | 6 | −1 | 13 |
| Impact-absorbing energy | J | 3.7 | 3.6 | 3.6 | 3.8 | 3.8 |
| Three-point flexural strength (A point) | — | 100% | 87% | 87% | 112% | 112% |
| Three-point flexural strength (AB middle point) | — | 100% | 112% | 86% | 112% | 86% |

TABLE 7

Specifications and results of evaluations for Examples and Comparative Examples

| Item | Unit | Ex. 1 | Comp. Ex. 8 | Comp. Ex. 9 | Comp. Ex. 10 |
|---|---|---|---|---|---|
| Shaft weight | g | 63.0 | 63.0 | 63.0 | 67.0 |
| Shaft length | mm | 1168 | 1168 | 1168 | 1168 |
| T6 | mm | 1.40 | 1.40 | 1.40 | 1.40 |
| T16 | mm | 0.92 | 0.92 | 0.92 | 1.25 |
| E6 | kgf · $m^2$ | 2.53 | 2.70 | 2.82 | 2.53 |
| E16 | kgf · $m^2$ | 3.13 | 3.13 | 3.13 | 3.70 |
| E16/E6 | — | 1.24 | 1.16 | 1.11 | 1.46 |
| E6/T6 | — | 1.81 | 1.93 | 2.01 | 1.81 |
| E16/T16 | — | 3.40 | 3.40 | 3.40 | 2.96 |
| Fiber elastic modulus of high-elasticity partial reinforcement layer used in region RG16 | — | 33t | 33t | 33t | 24t |
| Use of glass partial reinforcement layer in region RG6 | — | ○ | x | x | ○ |

TABLE 7-continued

Specifications and results of evaluations for Examples and Comparative Examples

| Item | Unit | Ex. 1 | Comp. Ex. 8 | Comp. Ex. 9 | Comp. Ex. 10 |
|---|---|---|---|---|---|
| Use of low-elasticity partial reinforcement layer in region RG6 | — | ○ | ○ | x | ○ |
| Head speed | m/s | 42 | 42 | 42 | 41.2 |
| Flight distance carry | yds | 200 | 199 | 198 | 189 |
| Position of point where ball falls in right or left direction | yds | 0 | 3 | 5 | −9 |
| Impact-absorbing energy | J | 3.7 | 3.3 | 2.9 | 3.7 |
| Three-point flexural strength (A point) | — | 100% | 103% | 105% | 100% |
| Three-point flexural strength (AB middle point) | — | 100% | 100% | 100% | 145% |

TABLE 8

Specifications and results of evaluations for Examples

| Item | Unit | Ex. 1 | Ex. 11 | Ex. 12 | Ex. 13 |
|---|---|---|---|---|---|
| Shaft weight | g | 63.0 | 63.0 | 63.0 | 63.0 |
| Shaft length | mm | 1168 | 1168 | 1168 | 1168 |
| T6 | mm | 1.40 | 1.40 | 1.40 | 1.40 |
| T16 | mm | 0.92 | 0.92 | 0.92 | 0.92 |
| E6 | kgf · $m^2$ | 2.53 | 2.53 | 2.53 | 2.53 |
| E16 | kgf · $m^2$ | 3.13 | 3.13 | 3.13 | 3.13 |
| E16/E6 | — | 1.24 | 1.24 | 1.24 | 1.24 |
| E6/T6 | — | 1.81 | 1.81 | 1.81 | 1.81 |
| E16/T16 | — | 3.40 | 3.40 | 3.40 | 3.40 |
| Fiber elastic modulus of high-elasticity partial reinforcement layer used in region RG16 | — | 33t | 33t | 33t | 33t |
| Use of glass partial reinforcement layer in region RG6 | — | ○ | ○ | ○ | ○ |
| Use of low-elasticity partial reinforcement layer in region RG6 | — | ○ | ○ | ○ | ○ |
| Head speed | m/s | 42 | 42 | 42 | 42 |
| Flight distance carry | yds | 200 | 200 | 200 | 199 |
| Position of point where ball falls in right or left direction | yds | 0 | 1 | −1 | 0 |
| Impact-absorbing energy | J | 3.7 | 3.4 | 3.6 | 3.5 |
| Three-point flexural strength (A point) | — | 100% | 100% | 98% | 99% |
| Three-point flexural strength (AB middle point) | — | 100% | 99% | 100% | 99% |

Evaluation methods are as follows.

[Ball-Hitting Test]

Ten right-handed testers hit balls. The ten testers had a handicap of 10 to 20. "SRIXON Z-STAR" manufactured by Dunlop Sports Co., Ltd. was used as the ball. Each of the testers hit ten balls with each of the clubs.

In the ball-hitting test, a head speed, a flight distance carry, and a position of a point where a ball fell in a right or left direction were measured. The flight distance carry is a flight distance at a point where a ball falls. The position of a point where a ball falls in a right or left direction is a distance of deviation of the point where a ball falls from a target direction. The deviation in the right direction was shown by a positive value and the deviation in the left direction was shown by a negative value. Therefore, the position of the point where a ball falls in a right or left direction being shown by the positive value means difficult capturing, which makes a hit ball slice. The position of the point where a ball falls in a right or left direction being shown by the negative value means excessive capturing, which makes a hit ball hook. From the viewpoint of suppressing slice to increase a flight distance, capturing is preferably easy. However, excessive capturing also decreases the flight distance. Therefore, the position of the point where a ball falls in a right or left direction is preferably closer to 0. Average values of all the shots by all the testers are shown in the above Tables 3 to 8.

[EI (Flexural Rigidity)]

Figure 6:
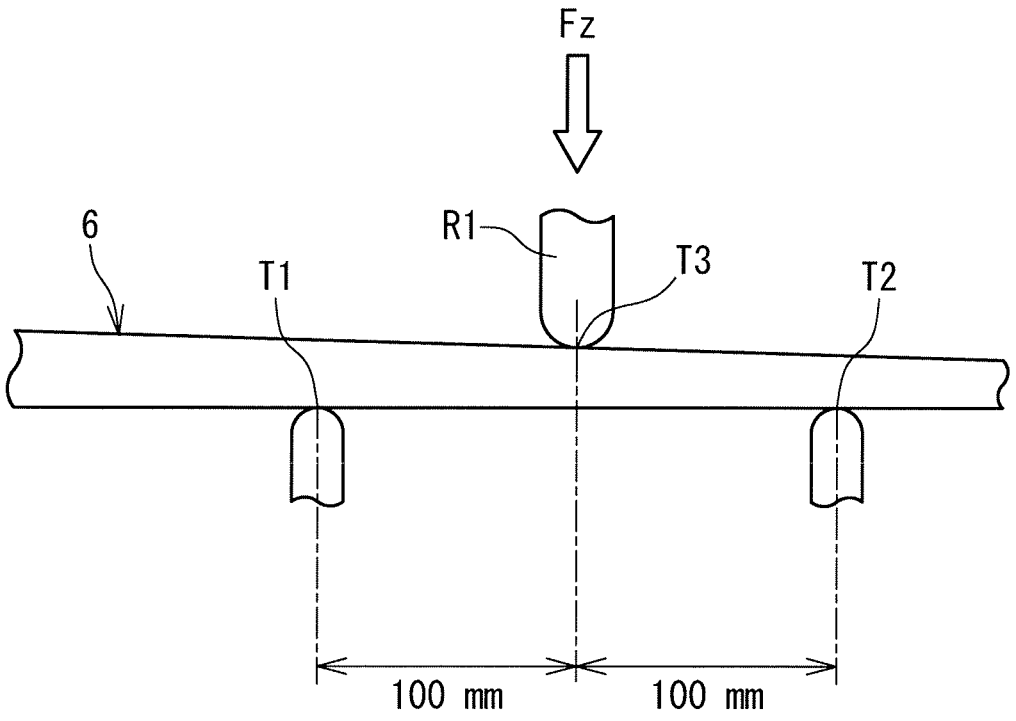
FIG. 6 is a schematic view showing a method for measuring an EI value.

FIG. 6 schematically shows a method for measuring flexural rigidity EI. EI is measured using a universal material testing machine, Type 2020 (maximum load: 500 kg) manufactured by INTESCO Co., Ltd. A shaft 6 is supported from beneath at a first support point T1 and a second support point T2. A load Fz is applied from above to a measurement point T3 while keeping the supports. The direction of the load Fz is the vertically downward direction. The distance between the point T1 and the point T2 is 200 mm. The measurement point T3 is set to a position by which the distance between the point T1 and the point T2 is divided into two equal parts. A deflection amount H generated by applying the load Fz is measured. The load Fz is applied with an indenter R1. The tip of the indenter R1 is a cylindrical surface having a curvature radius of 5 mm. The downwardly moving speed of the indenter R1 is 5 ram/min. The moving of the indenter R1 is stopped when the load Fz1 reaches 20 kgf (196 N), and a deflection amount H at the time is measured. The deflection amount H is the amount of displacement of the point T3 in the vertical direction. EI is calculated by the following formula:

$$EI(kgf\cdot m^2)=Fz\times L^3/(48\times H),$$

where Fz represents the maximum load (kgf), L represents the distance between the support points (m), and H represents the deflection amount (m). The maximum load Fz is 20 kgf, and the distance L between the support points is 0.2 m.

[Three-Point Flexural Strength]

Figure 7:
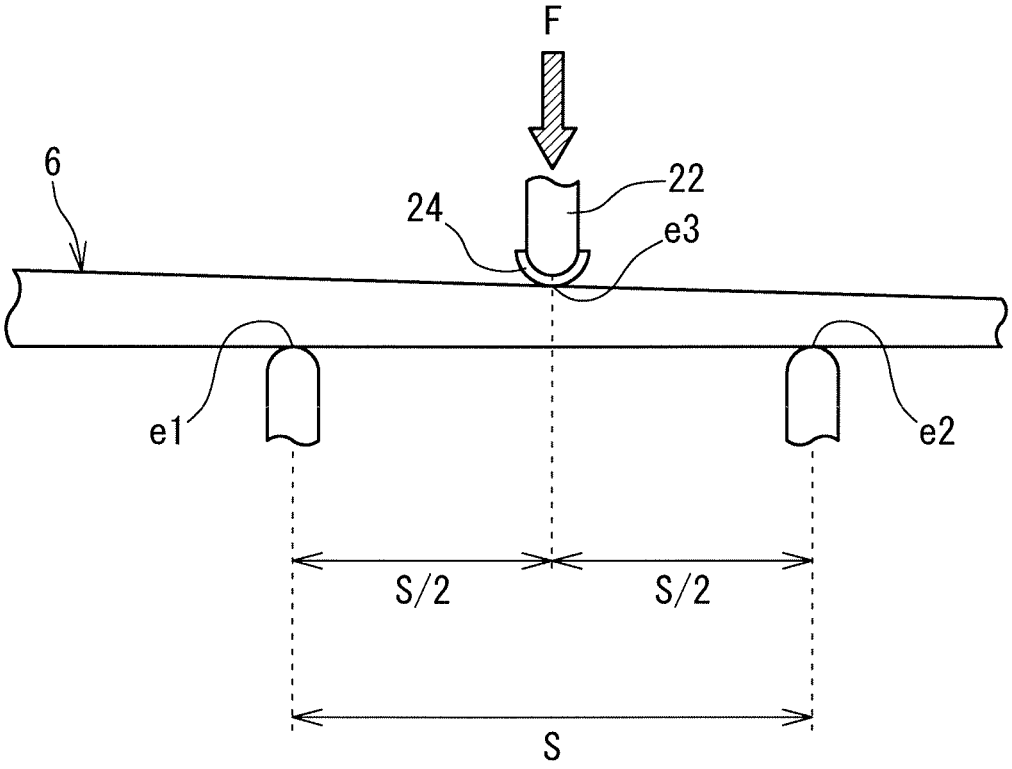
FIG. 7 is a schematic view showing a method for measuring three-point flexural strength.

FIG. 7 shows a method for measuring three-point flexural strength. The three-point flexural strength was measured based on an SG type three-point flexural strength test. The test is set by Consumer Product Safety Association in Japan. A point A and an AB middle point were measured as measured points. The point A is set by the test, and is a point separated by 175 mm from a tip end Tp. The AB middle point is a middle point between the point A and a point B which are defined by the test, and is a point separated by 350 mm from the tip end Tp. The point A is close to a point P6, and is included in a region RG6. The AB middle point is close to the point P16, and is included in a region RG16.

As shown in FIG. 7, while a shaft 6 was supported from below at two supporting points e1 and e2, a load F was applied downward from above at a load point e3 by an indenter 22. A silicone rubber 24 was attached to a tip part of the indenter 22. The load point e3 was at a position by which a distance between the supporting points e1 and e2 is divided into two equal parts. The load point e3 is the measured point. The span S was set to 300 mm. A value (peak value) of a load F when the shaft 6 was broken was measured. The above FIGS. 3 to 8 show the percent of the measured value when the value of Example 1 is defined as 100%.

[Impact-Absorbing Energy]

Figure 8:
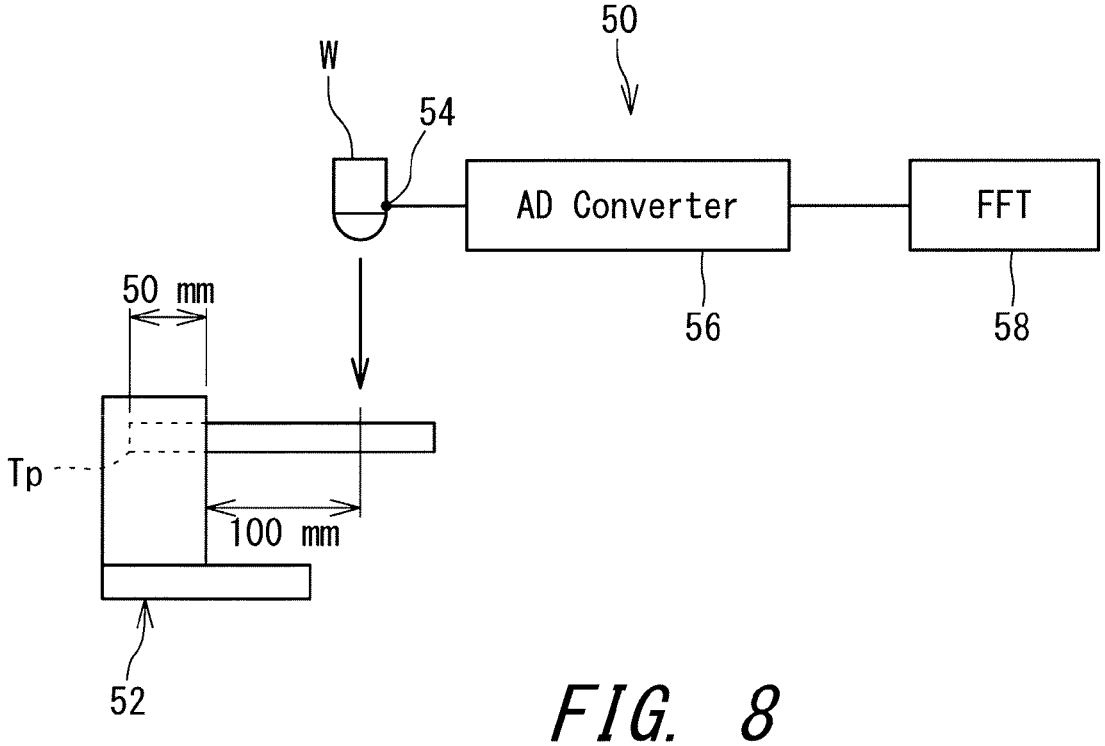
FIG. 8 is a schematic view showing a method for measuring an impact-absorbing energy.

FIG. 8 shows a method for determining an impact-absorbing energy. An impact test was conducted by a cantilever bending method. A drop weight impact tester (IITM-18) manufactured by Yonekura MFG Co., Ltd. was used as a measuring apparatus 50. A tip part between a tip Tp of the shaft and a point separated by 50 mm from the tip Tp was fixed to a fixing jig 52. A weight W of 600 g was dropped to the shaft at a position separated by 100 mm from the fixed end, from the upper side at 1500 mm above the position. An accelerometer 54 was attached to the weight W. The accelerometer 54 was connected to an FFT analyzer 58 through an AD converter 56. A measurement wave profile was obtained by an FFT treatment. Displacement D and an impact flexural load L were determined by the measurement to calculate an impact-absorbing energy before breakage started. The value is shown in the above Tables 3 to 8.

Figure 9:
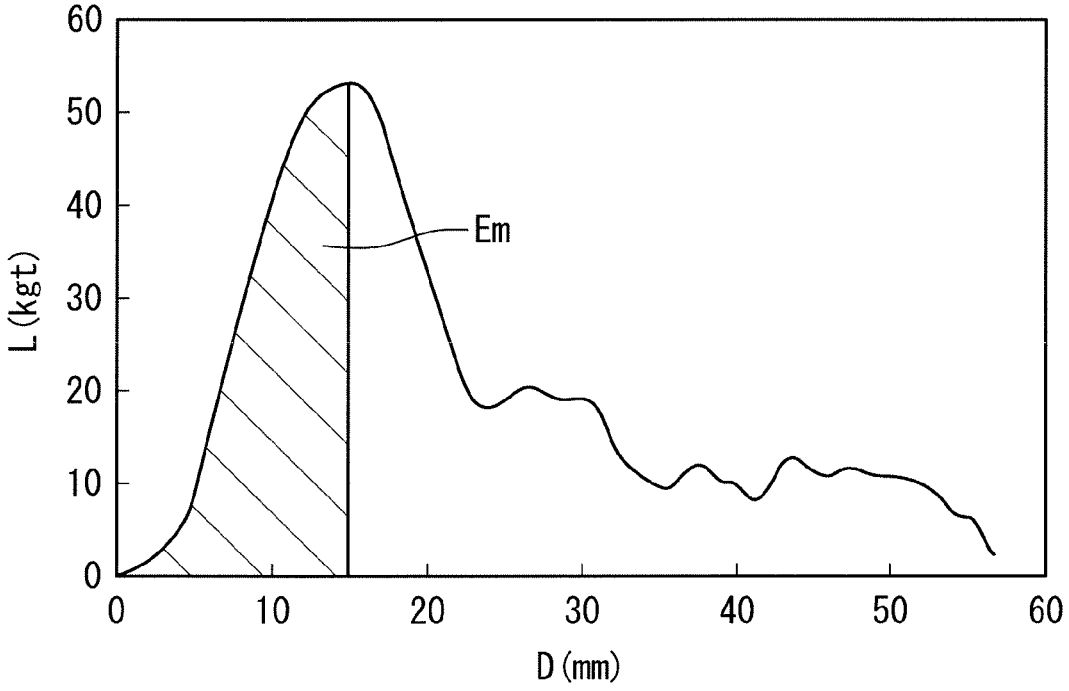
FIG. 9 shows an example of a wave profile obtained in measurement of the impact-absorbing energy.

FIG. 9 is an example of the measured wave profile. The wave profile is a graph showing the relationship between the displacement D (mm) and the impact flexural load L (kgf). In the graph of FIG. 9, the area of a portion shown by hatching represents an impact-absorbing energy Em (J).

As shown in Table 3, in Examples 1 to 3, capturing is easy, and a flight distance is long. In Comparative Example 1, the fiber elastic modulus of the partial reinforcement layer disposed in the region RG16 is low, and E16/T16 is small. For this reason, capturing is difficult, and a flight distance is decreased. In Comparative Example 2, the fiber elastic modulus of the partial reinforcement layer disposed in the region RG16 is high, and E16/T16 is great. For this reason, capturing becomes excessive, and a flight distance is decreased.

As shown in Table 4, the strength of the point A in Example 4 is different from the strength of the point A in Example 5, but in Examples 4 and 5, capturing is easy, and a flight distance is long. In Comparative Example 3, the thicknesses T6 and E6 are small, and E16/E6 is great. For this reason, capturing becomes excessive. In Comparative Example 4, the thickness T6 is great, and E6 is too great. For this reason, the weight of the shaft is great, and the head speed is decreased.

As shown in Table 5, in Examples 6 to 8, because of the differences in T16 and the shaft weight, or the like, head speeds are different, but capturing is easy. In Comparative Example 5, T16 is small; E16 is small; and E16/E6 and E16/T16 are also small. For this reason, capturing is difficult, and the strength of the AB middle point is low.

As shown in Table 6, in Examples 9 and 10, because of the difference in the shaft weight, or the like, head speeds are different, but capturing is easy. In Comparative Example 6, E16/E6 is great, and capturing is excessive. In Comparative Example 7, E16/E6 is small, and capturing is difficult.

As shown in Table 7, since the glass partial reinforcement layer is absent in Comparative Example 8, an impact-absorbing energy is small. Since the glass partial reinforcement layer and the low-elasticity partial reinforcement layer are absent in Comparative Example 9, an impact-absorbing energy is further smaller. In Comparative Example 10 , T16 is great, and a shaft weight is great. E16/T16 is small. For this reason, a head speed and a flight distance are decreased.

As shown in Table 8, since the glass partial reinforcement layer is disposed outside, and the low-elasticity partial reinforcement layer is disposed inside in Example 11, an impact-absorbing energy is slightly low. Since the glass partial reinforcement layer is moved to the outside in Example 12, the impact-absorbing energy of Example 12 is lower than the impact-absorbing energy of Example 1. Since the low-elasticity partial reinforcement layer is moved to the inside in Example 13, the impact-absorbing energy of Example 13 is lower than the impact-absorbing energy of Example 1.

Thus, Examples are highly evaluated as compared with Comparative Examples. The advantages of the present invention are apparent.

The shafts described above can be used for any golf clubs.

The description hereinabove is merely for an illustrative example, and various modifications can be made in the scope not to depart from the principles of the present invention.

What is claimed is:

1. A golf club shaft formed by a plurality of fiber reinforced layers, and comprising a tip end and a butt end, wherein if an EI value at a point P16 separated by 16 inches from the tip end is defined as E16 (kgf·m$^2$); a shaft wall thickness at the point P16 is defined as T16 (mm); an EI value at a point P6 separated by 6 inches from the tip end is defined as E6 (kgf·m$^2$); and a shaft wall thickness at the point P6 is defined as T6 (mm), E16 is equal to or greater than 2.4 (kgf·m$^2$); E6 is equal to or less than 2.7 (kgf·m$^2$); E16/E6 is 0.95 or greater but 1.50 or less; E6/T6 is equal to or less than 1.9; E16/T16 is equal to or greater than 3.0; and a high-elasticity partial reinforcement layer including a fiber having a tensile elastic modulus of 31 (t/mm$^2$) or greater but 40 (t/mm$^2$) or less is disposed in at least a part of a region falling within a range of ±1 inches from the point P16.

2. The golf club shaft according to claim 1, wherein a glass partial reinforcement layer including a glass fiber is disposed in at least a part of a region falling within a range of ±4 inches from the point P6.

3. The golf club shaft according to claim 2, wherein the glass partial reinforcement layer is disposed on an inner side with respect to a radial position by which the shaft wall thickness is divided into two equal parts.

4. The golf club shaft according to claim 3, wherein the glass partial reinforcement layer is an innermost layer.

5. The golf club shaft according to claim 1, wherein a low-elasticity partial reinforcement layer including a pitch-based carbon fiber having a tensile elastic modulus of equal to or less than 10 (t/mm$^2$) is disposed in at least a part of a region falling within a range of ±4 inches from the point P6.

6. The golf club shaft according to claim 5, wherein the low-elasticity partial reinforcement layer is disposed on an outer side with respect to a radial position by which the shaft wall thickness is divided into two equal parts.

7. The golf club shaft according to claim 6, wherein the low-elasticity partial reinforcement layer is disposed at a radial position adjacent to an outermost layer.

8. The golf club shaft according to claim 1, wherein an axial-direction length of the high-elasticity partial reinforcement layer is 300 mm or greater but 550 mm or less.

9. The golf club shaft according to claim 2, wherein an axial-direction length of the glass partial reinforcement layer is 50 mm or greater but 300 mm or less.

10. The golf club shaft according to claim 5, wherein an axial-direction length of the low-elasticity partial reinforcement layer is 50 mm or greater but 300 mm or less.

11. The golf club shaft according to claim 1, wherein the high-elasticity partial reinforcement layer is not present in a region on a butt side with respect to a point P22 separated by 22 inches from the tip end.

12. The golf club shaft according to claim 1, wherein the high-elasticity partial reinforcement layer is not present in a region on a butt side with respect to a point P21 separated by 21 inches from the tip end.

13. The golf club shaft according to claim 1, wherein the high-elasticity partial reinforcement layer is not present in a region on a butt side with respect to a point P20 separated by 20 inches from the tip end.

14. A golf club shaft formed by a plurality of fiber reinforced layers, and comprising a tip end and a butt end, wherein if an EI value at a point P16 separated by 16 inches from the tip end is defined as E16 (kgf·m$^2$); a shaft wall thickness at the point P16 is defined as T16 (mm); an EI value at a point P6 separated by 6 inches from the tip end is defined as E6 (kgf·m$^2$); and a shaft wall thickness at the point P6 is defined as T6 (mm), E16 is equal to or greater than 2.4 (kgf·m$^2$); E6 is equal to or less than 2.7 (kgf·m$^2$); E16/E6 is 0.95 or greater but 1.50 or less; E6/T6 is equal to or less than 1.9; E16/T16 is equal to or greater than 3.0, a high-elasticity partial reinforcement layer including a fiber having a tensile elastic modulus of 31 (t/mm$^2$) or greater but 40 (t/mm$^2$) or less is disposed in at least a part of a region falling within a range of ±4 inches from the point P16, the high-elasticity partial reinforcement layer is not present in a region on a butt side with respect to a point P22 separated by 22 inches from the tip end, no high-elastic fiber-containing partial reinforcement layer is present in the region on the butt side with respect to the point P22 separated by 22 inches from the tip end, and the high-elastic fiber-containing partial reinforcement layer is a layer containing a fiber having a tensile elastic modulus of 30 (t/mm$^2$) or greater but 40 (t/mm$^2$) or less.

15. A golf club shaft formed by a plurality of fiber reinforced layers, and comprising a tip end and a butt end, wherein if an EI value at a point P16 separated by 16 inches from the tip end is defined as E16 (kgf·m$^2$); a shaft wall thickness at the point P16 is defined as T16 (mm); an EI value at a point P6 separated by 6 inches from the tip end is defined as E6 (kgf·m$^2$); and a shaft wall thickness at the point P6 is defined as T6 (mm), E16 is equal to or greater than 2.4 (kgf·m$^2$); E6 is equal to or less than 2.7 (kgf·m$^2$); E16/E6 is 0.95 or greater but 1.50 or less; E6/T6 is equal to or less than 1.9; E16/T16 is equal to or greater than 3.0; and a high-elasticity partial reinforcement layer including a fiber having a tensile elastic modulus of 30 (t/mm$^2$) or greater but 40 (t/mm$^2$) or less is disposed in at least a part of a region falling within a range of ±1 inches from the point P16.

* * * * *